US008857520B2

(12) United States Patent
Hoffman et al.

(10) Patent No.: US 8,857,520 B2
(45) Date of Patent: Oct. 14, 2014

(54) EMERGENCY DISCONNECT SYSTEM FOR RISERLESS SUBSEA WELL INTERVENTION SYSTEM

(75) Inventors: Corey Eugene Hoffman, Plantersville, TX (US); Stace Brac McDaniel, Tomball, TX (US); Paul Alexander Blaikie, Aberdeen (GB)

(73) Assignee: Wild Well Control, Inc., Houston, TX (US)

( * ) Notice: Subject to any disclaimer, the term of this patent is extended or adjusted under 35 U.S.C. 154(b) by 610 days.

(21) Appl. No.: 13/095,596

(22) Filed: Apr. 27, 2011

(65) Prior Publication Data

US 2012/0273219 A1 Nov. 1, 2012

(51) Int. Cl.
*E21B 7/12* (2006.01)
*E21B 33/035* (2006.01)
*E21B 33/038* (2006.01)

(52) U.S. Cl.
CPC ..... *E21B 33/038* (2013.01); *E21B 33/035* (2013.01)
USPC ..... 166/351; 166/338; 166/363; 166/341

(58) Field of Classification Search
CPC ..... E21B 19/16
USPC ..... 166/341, 351, 343, 338, 345, 349
See application file for complete search history.

(56) References Cited

U.S. PATENT DOCUMENTS 3,504,740 A * 4/1970 Manning ..... 166/339
3,921,500 A 11/1975 Silcox
4,004,635 A * 1/1977 Marquaire et al. ..... 166/343
4,149,603 A * 4/1979 Arnold ..... 175/7
4,271,865 A 6/1981 Galloway et al.
4,685,521 A * 8/1987 Raulins ..... 166/341
4,742,792 A * 5/1988 Mank et al. ..... 114/264
5,095,946 A 3/1992 McLennan
5,129,621 A 7/1992 Maiville et al.
5,398,761 A 3/1995 Reynolds et al.
5,492,147 A 2/1996 Challender et al.
5,595,217 A 1/1997 Gillen et al.
5,881,815 A * 3/1999 Horton, III ..... 166/350
5,887,619 A 3/1999 Keary
5,971,077 A * 10/1999 Lilley ..... 166/368
6,125,938 A * 10/2000 Garcia-Soule et al. ..... 166/344

(Continued)

FOREIGN PATENT DOCUMENTS

WO 03070565 A2 8/2003
WO 2004065757 A2 8/2004
WO 2010/019675 A2 2/2010

OTHER PUBLICATIONS

U.S. Appl. No. 13/018,871, filed Feb. 1, 2011, Hoffman et al.

(Continued)

*Primary Examiner* — Matthew Buck
*Assistant Examiner* — Aaron Lembo
(74) *Attorney, Agent, or Firm* — Patterson & Sheridan, L.L.P.

(57) ABSTRACT

A method for riserless intervention of a subsea well includes: lowering a pressure control assembly (PCA) from a vessel to a subsea production tree; fastening the PCA to the tree; lowering a control pod from the vessel to the PCA using an umbilical; fastening the control pod to the PCA; lowering an end of a fluid conduit from the vessel to the PCA; and fastening the fluid conduit to the PCA using a dry break connection.

14 Claims, 14 Drawing Sheets

(56) References Cited

U.S. PATENT DOCUMENTS

| | | | | |
|---|---|---|---|---|
| 6,129,151 | A * | 10/2000 | Crotwell | 166/359 |
| 6,591,913 | B2 | 7/2003 | Reaux et al. | |
| 6,715,554 | B1 * | 4/2004 | Cunningham et al. | 166/348 |
| 6,843,321 | B2 * | 1/2005 | Carlsen | 166/355 |
| 6,938,695 | B2 * | 9/2005 | Williams | 166/341 |
| 6,945,273 | B2 | 9/2005 | Reid | |
| 7,168,794 | B2 | 1/2007 | Wouters | |
| 7,264,057 | B2 * | 9/2007 | Rytlewski et al. | 166/338 |
| 7,331,393 | B1 * | 2/2008 | Hoel | 166/336 |
| 7,331,394 | B2 * | 2/2008 | Edwards et al. | 166/339 |
| 7,395,866 | B2 * | 7/2008 | Milberger et al. | 166/345 |
| 7,431,092 | B2 | 10/2008 | Haheim et al. | |
| 7,487,836 | B2 * | 2/2009 | Boyce et al. | 166/340 |
| 7,770,655 | B2 * | 8/2010 | Wilde et al. | 166/381 |
| 7,984,765 | B2 * | 7/2011 | Askeland | 166/339 |
| 8,297,359 | B2 * | 10/2012 | McKay et al. | 166/359 |
| 8,316,947 | B2 * | 11/2012 | Sack | 166/345 |
| 8,347,916 | B2 * | 1/2013 | June | 137/613 |
| 8,393,399 | B2 * | 3/2013 | Judge | 166/366 |
| 8,403,055 | B2 * | 3/2013 | Parfrey | 166/339 |
| 8,439,109 | B2 * | 5/2013 | Sbordone | 166/250.01 |
| 2003/0006070 | A1 | 1/2003 | Dean | |
| 2004/0154804 | A1 | 8/2004 | Williams | |
| 2004/0159438 | A1 | 8/2004 | Reimert | |
| 2006/0231264 | A1 | 10/2006 | Boyce et al. | |
| 2009/0151956 | A1 * | 6/2009 | Johansen et al. | 166/350 |
| 2009/0294130 | A1 * | 12/2009 | Rodriguez | 166/341 |
| 2010/0084588 | A1 | 4/2010 | Curtiss, III et al. | |
| 2010/0155073 | A1 | 6/2010 | Blank et al. | |
| 2010/0155074 | A1 * | 6/2010 | Rodriguez | 166/341 |
| 2010/0181075 | A1 | 7/2010 | Reynolds | |
| 2010/0229981 | A1 * | 9/2010 | June | 137/614.02 |
| 2011/0079395 | A1 * | 4/2011 | Vaynshteyn et al. | 166/345 |
| 2011/0297389 | A1 * | 12/2011 | McKay | 166/349 |
| 2012/0197527 | A1 * | 8/2012 | McKay et al. | 702/6 |

OTHER PUBLICATIONS

International Search Report and Written Opinion dated Sep. 21, 2012, International Application No. PCT/US2012/035619.

Wallace, Rhea—"Subsea Tool Developed for Well Intervention and Abandonment," Technology Update, Jul. 2003, p. 22.

* cited by examiner 300
320
315
326
351
310
411
413
400
404
325
305
341
352
340
405
417
450
416
100
415
50

351
361
341
326
352
340

351
361
341
352
340
353

356
360
200
357
355
250

EMERGENCY DISCONNECT SYSTEM FOR RISERLESS SUBSEA WELL INTERVENTION SYSTEM

BACKGROUND OF THE INVENTION

1. Field of the Invention

Embodiments of the present invention generally relate to an emergency disconnect system for a riserless subsea well intervention system.

2. Description of the Related Art

Subsea crude oil and/or natural gas wells frequently require workover to maintain adequate production. Workover operations may include perforating, gravel packing, production stimulation and repair of a downhole completion or production tubing. During the workover, specialized tools are lowered into the well by means of a wireline and winch. This wireline winch is typically positioned on the surface and the workover tool is lowered into the well through a lubricator and blowout preventer (BOP). Workover operations on subsea wells require specialized intervention equipment to pass through the water column and to gain access to the well. The system of valves on the wellhead is commonly referred to as a production or Christmas tree and the intervention equipment is attached to the tree with a blowout preventer (BOP).

The commonly used method for accessing a subsea well first requires installation of a BOP with a pre-attached tree running tool (TRT) for guiding the BOP to correctly align and interface with the tree. The BOP/running tool is lowered from a derrick that is mounted on a mobile offshore drilling unit (MODU), such as a drill ship or semi-submersible platform. The BOP/TRT is lowered on a segmented length of pipe called a workover riser string. The BOP/TRT is lowered by adding sections of pipe to the riser string until the BOP/TRT is sufficiently deep to allow landing on the tree. After the BOP is attached to the tree, the workover tool is lowered into the well through a lubricator mounted on the top of the riser string. The lubricator provides a sealing system at the entrance of the wireline that maintains the pressure and fluids inside the well and the riser string. The main disadvantage of this method is the large, specialized MODU that is required to deploy the riser string and the riser string needed to deploy the BOP.

FIG. 1A illustrates a prior art completed subsea well. A wellbore 10 has been drilled from a floor if of the sea 1 into a hydrocarbon-bearing (i.e., crude oil and/or natural gas) reservoir (not shown). A string of casing (not shown) has been run into the wellbore and set therein with cement (not shown). The casing has been perforated to provide to provide fluid communication between the reservoir and a bore of the casing. A wellhead (not shown) has been mounted on an end of the casing string. A string of production tubing 10*p* (see FIG. 1B) may extend from the wellhead (not shown) to the formation to transport production fluid from the formation to the seafloor 1*f*. A packer (not shown) may be set between the production tubing 10*p* and the casing to isolate an annulus 10*a* (see FIG. 1B) formed between the production tubing 10*p* and the casing (not shown) from production fluid.

FIG. 1B illustrates a prior art horizontal production tree 50. The production tree 50 may be connected to the wellhead, such as by a collet, mandrel, or clamp tree connector. The tree 50 may be vertical or horizontal. If the tree is vertical (not shown), it may be installed after the production tubing 10*p* is hung from the wellhead. If the tree 50 is horizontal (as shown), the tree may be installed and then the production tubing 10*p* may be hung from the tree 50. The tree 50 may include fittings and valves to control production from the wellbore into a pipeline (not shown) which may lead to a production facility (not shown), such as a production vessel or platform. The tree 50 may also be in fluid communication with a hydraulic conduit (not shown) controlling a subsurface safety valve SSV 10*v* (not shown).

The tree 50 may include a head 51, a wellhead connector 52, a tubing hanger 53, an internal cap 54, an external cap 55, an upper crown plug 56*u*, a lower crown plug 56*l*, a production valve 57*p*, and one or more annulus valves 57*u,l*. Each of the components 51-54 may have a longitudinal bore extending therethrough. The tubing hanger 53 and head 51 may each have a lateral production passage formed through walls thereof for the flow of production fluid. The tubing hanger 53 may be disposed in the head bore. The tubing hanger 53 may support the production tubing 10*p*. The tubing hanger 53 may be fastened to the head by a latch 53*l*. The latch 53*l* may include one or more fasteners, such as dogs, and an actuator, such as a cam sleeve. The cam sleeve may be operable to push the dogs outward into a profile formed in an inner surface of the tree head 51. The latch 53*l* may further include a collar for engagement with a running tool (not shown) for installing and removing the tubing hanger 53.

The tubing hanger 53 may be rotationally oriented and longitudinally aligned with the tree head 51. The tubing hanger 53 may further include seals 53*s* disposed above and below the production passage and engaging the tree head inner surface. The tubing hanger 53 may also have a number of auxiliary ports/conduits (not shown) spaced circumferentially there-around. Each port/conduit may align with a corresponding port/conduit (not shown) in the tree head 51 for communicating hydraulic fluid or electricity for various purposes to tubing hanger 53, and from tubing hanger 53 downhole, such as for operation of the SSV. The tubing hanger 53 may have an annular, partially spherical exterior portion that lands within a partially spherical surface formed in tree head 51.

The annulus 10*a* may communicate with an annulus passage formed through and along the head 51 for and bypassing the seals 53*s*. The annulus passage may be accessed by removing internal tree cap 54. The tree cap 54 may be disposed in head bore above tubing hanger 53. The tree cap 54 may have a downward depending isolation sleeve received by an upper end of tubing hanger 53. Similar to the tubing hanger 53, the tree cap 54 may include a latch 54*l* fastening the tree cap to the head 51. The tree cap 54 may further include a seal 54*s* engaging the head inner surface. The production valve 57*p* may be disposed in the production passage and the annulus valves 57*u,l* may be disposed in the annulus passage. Ports/conduits (not shown) may extend through the tree head 51 to a tree controller (not shown) for electrical or hydraulic operation of the valves.

The upper crown plug 56*u* may be disposed in tree cap bore and the lower crown plug 56*l* may be disposed in the tubing hanger bore. Each crown plug 56*u,l* may have a body with a metal seal on its lower end. The metal seal may be a depending lip that engages a tapered inner surface of the respective cap and hanger. The body may have a plurality of windows which allow fasteners, such as dogs, to extend and retract. The dogs may be pushed outward by an actuator, such as a central cam. The cam may have a profile on its upper end. The cam may move between a lower locked position and an upper position freeing dogs to retract. A retainer may secure to the upper end of body to retain the cam.

SUMMARY OF THE INVENTION

Embodiments of the present invention generally relate to an emergency disconnect system for a riserless subsea well intervention system. In one embodiment, a method for riserless intervention of a subsea well includes: lowering a pressure control assembly (PCA) from a vessel to a subsea production tree; fastening the PCA to the tree; lowering a control pod from the vessel to the PCA using an umbilical; fastening the control pod to the PCA; lowering an end of a fluid conduit from the vessel to the PCA; and fastening the fluid conduit to the PCA using a dry break connection.

In another embodiment, a pressure control assembly (PCA) for riserless intervention of a subsea well includes: a bore formed therethrough; a production tree adapter having a connector for fastening the PCA to a subsea production tree and a seal sleeve for engaging an internal profile of the tree; a frame connected to the adapter; a fluid sub connected to the adapter and having a port in communication with the bore; an isolation valve connected to the fluid sub and operable to close the bore; a blow out preventer (BOP) connected to the isolation valve and operable to shear a workstring and close the bore; an accumulator for storing pressurized hydraulic fluid to operate the BOP; a tool housing connected to the blow out preventer; a control pod receptacle connected to the frame and having a base for receiving a control pod, a latch operable to engage the control pod, and an actuator for operating the latch; and a manifold connected to the frame and having a coupling of a dry break connection for receiving a mating coupling connected to a fluid conduit and operable to provide fluid communication between the fluid conduit and the bore.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

Figure 1A:
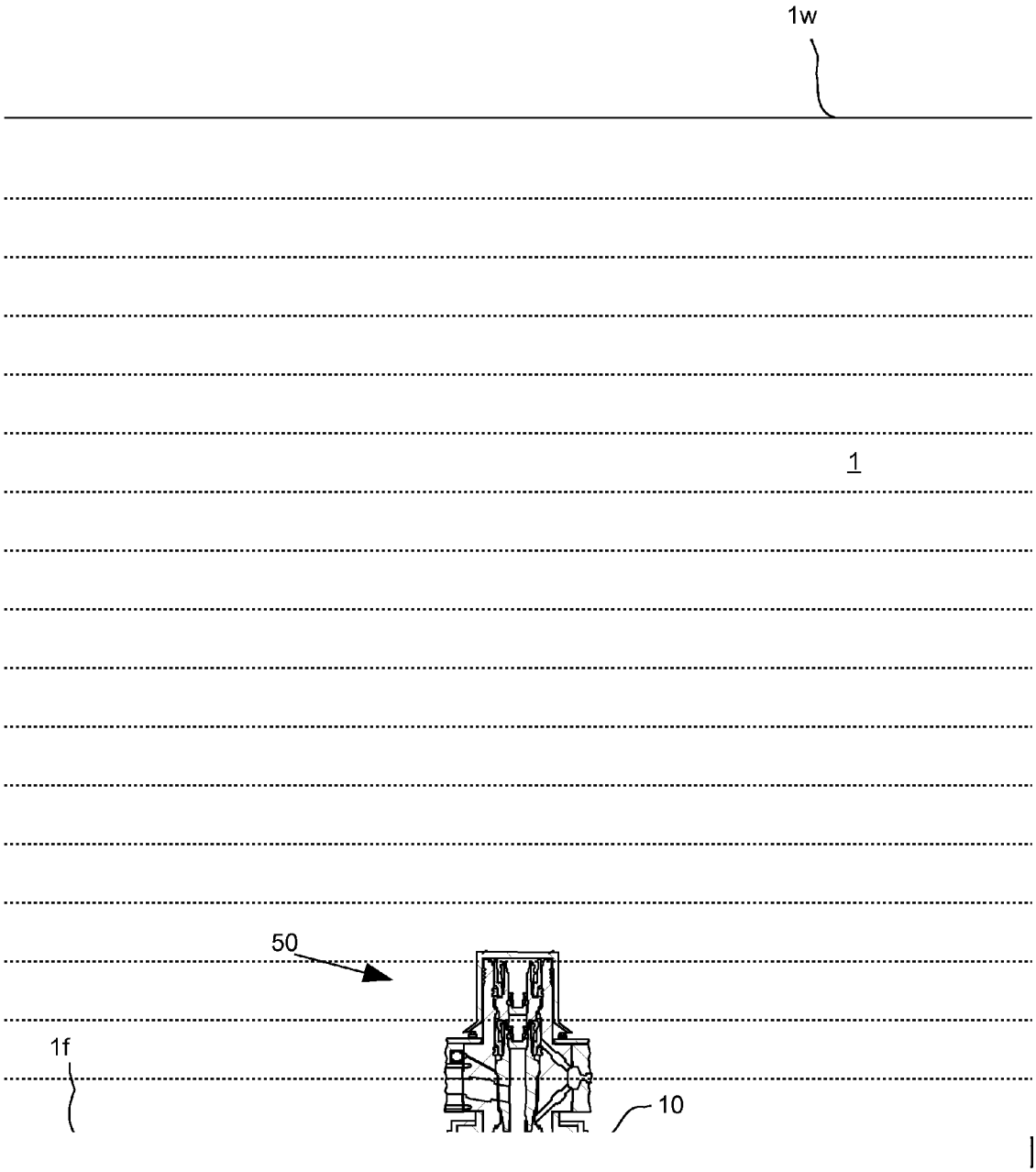
FIG. 1A (Prior Art)
FIG. 1A illustrates a prior art completed subsea well.
Figure 1B:
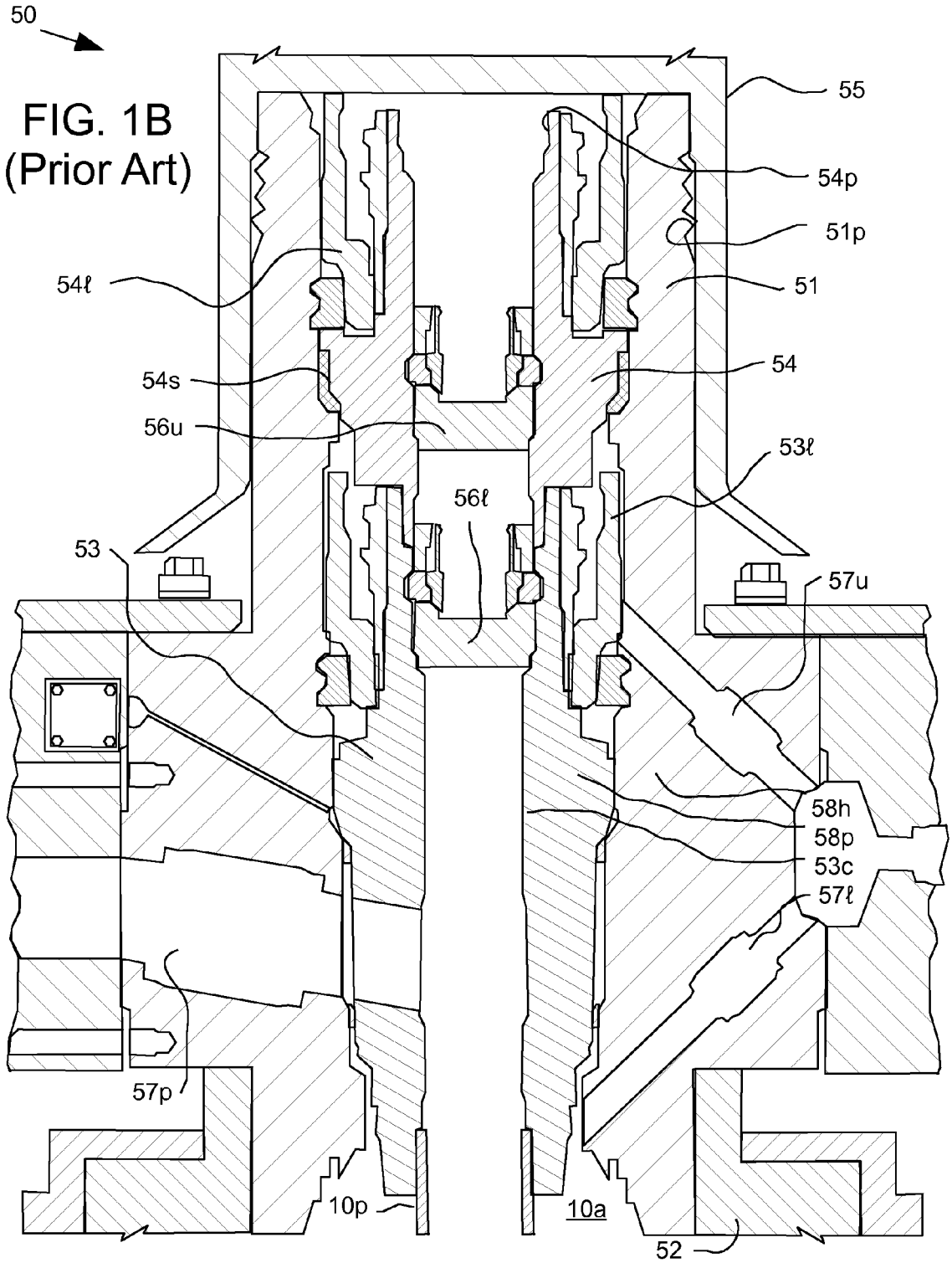
FIG. 1B (Prior Art)
FIG. 1B illustrates a prior art horizontal production tree.
Figure 2:
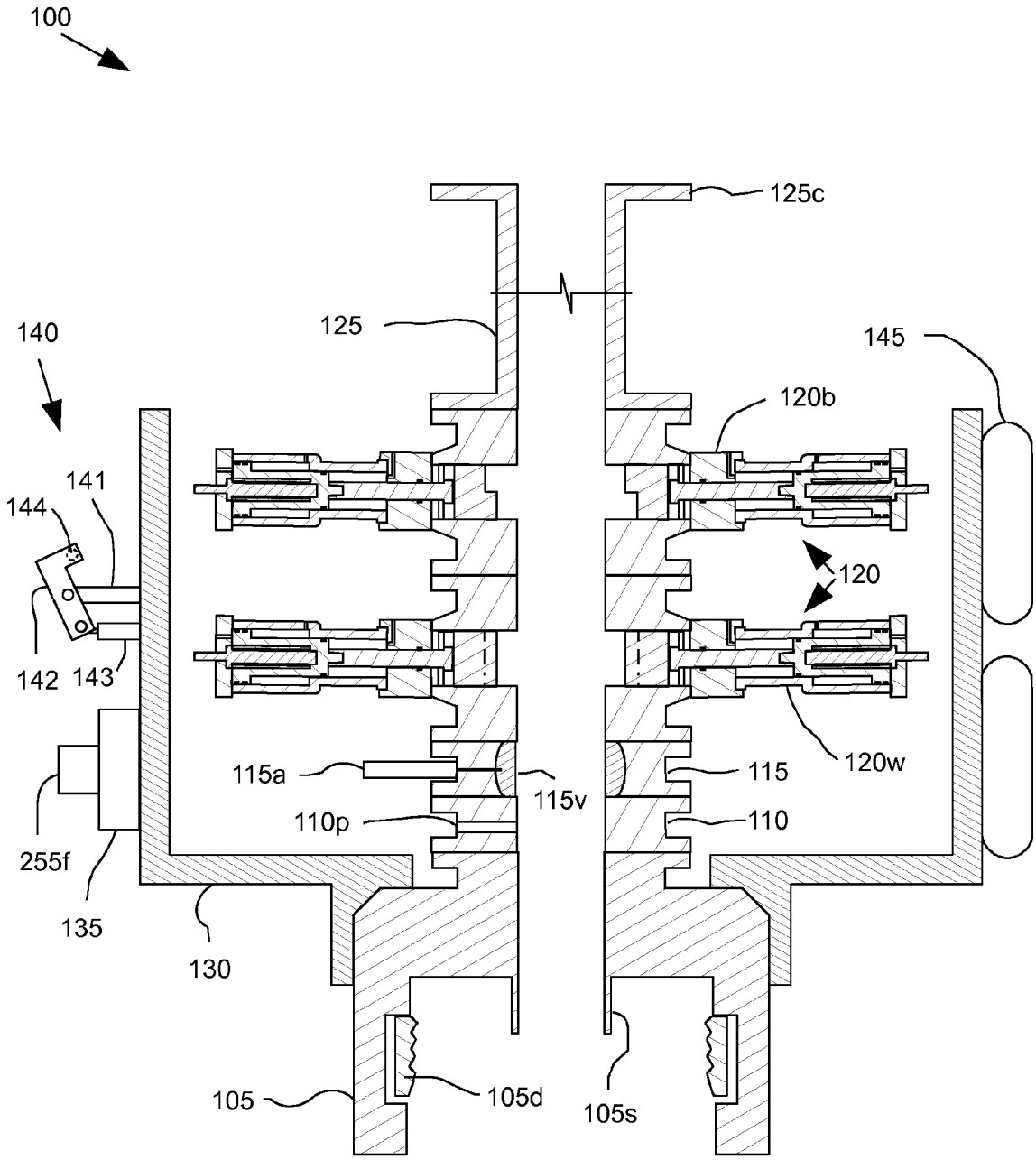
FIG. 2 illustrates a pressure control assembly (PCA), according to one embodiment of the present invention.

FIG. 2 illustrates a pressure control assembly (PCA) 100, according to one embodiment of the present invention. The PCA 100 may include a tree adapter 105, a fluid sub 110, an isolation valve 115, a blow out preventer (BOP) stack 120, a tool housing (aka lubricator riser) 125, a frame 130, a manifold 135, a pod receptacle 140, and one or more accumulators 145 (two shown). The tree connector 105, fluid sub 110, isolation valve 115, BOP stack 120, and tool housing 125 may each include a housing or body having a longitudinal bore therethrough and be connected, such as by flanges, such that a continuous bore is maintained therethrough. The bore may have a large drift diameter, such as greater than or equal to four, five, six, or seven inches to accommodate a bottom hole assembly (BHA) of a workstring (discussed more below) and the crown plugs 56*u,l* of the tree 50.

The tree adapter 105 may include a connector, such as dogs 105*d*, for fastening the PCA 100 to an external profile 51*p* of the tree 50 and a seal sleeve 105*s* for engaging an internal profile 54*p* of the tree. The tree adapter 105 may further include an electric or hydraulic actuator and an interface, such as a hot stab, so that a remotely operated subsea vehicle (ROV) 415 (see FIG. 4A) may operate the actuator for engaging the dogs 105*d* with the external profile 51*p*. The frame 130 may be connected to the tree connector 50, such as by fasteners (not shown). The manifold 135 may be fastened to the frame 130. The fluid sub 110 may include a housing having a bore therethrough and a port 110*p* in communication with the bore. The port 110*p* may be in fluid communication with the manifold 135 via a conduit (not shown).

The isolation valve 115 may include a housing, a valve member 115*v* disposed in the housing bore and operable between an open position and a closed position, and an actuator 115*a* operable to move the valve member between the positions. The actuator 115*a* may be electric or hydraulic and may be in communication with a stab plate (not shown) of the pod receptacle 140. The isolation valve 115 may further operate as a check valve in the closed position: allowing fluid flow downward from the tool housing into the wellbore and preventing reverse fluid flow therethrough. Alternatively, the isolation valve 115 may be bi-directional when closed, the PCA 100 may further include a bypass conduit (not shown) connected to a port of a drain sub (not shown) disposed between the isolation valve and the BOP stack, and the drain port may include a check valve allowing downward flow and preventing reverse flow.

The BOP stack 120 may include one or more hydraulically operated ram preventers 120*b,w*, such as a blind-shear preventer 120*b* and one or more workstring preventers 120*w*, such as a wireline preventer and a coiled tubing preventer (only one workstring preventer shown) connected together via bolted flanges. Each ram preventer 120*b,w* may include two opposed rams disposed within a body. The body may have a bore that is aligned with the wellbore. Opposed cavities may intersect the bore and support the rams as they move radially into and out of the bore. A bonnet may be connected to the body on the outer end of each cavity and may support an actuator that provides the force required to move the rams into and out of the bore. Each actuator may include a hydraulic piston to radially move each ram and a mechanical lock to maintain the position of the ram in case of hydraulic pressure loss. The lock may include a threaded rod, a motor (not shown) for rotationally driving the rod, and a threaded sleeve. Once each ram is hydraulically extended into the bore, the motor may be operated to push the sleeve into engagement with the piston. Each actuator may include single (shown) or dual pistons (not shown). The blind-shear preventer 120*b* may cut the workstring, such as coiled tubing, wireline, and even drill pipe, when actuated and seal the bore. The coiled tubing preventer may seal against an outer surface of coiled tubing when actuated and the wireline preventer may seal against an outer surface of the wireline when actuated.

Figure 5A:
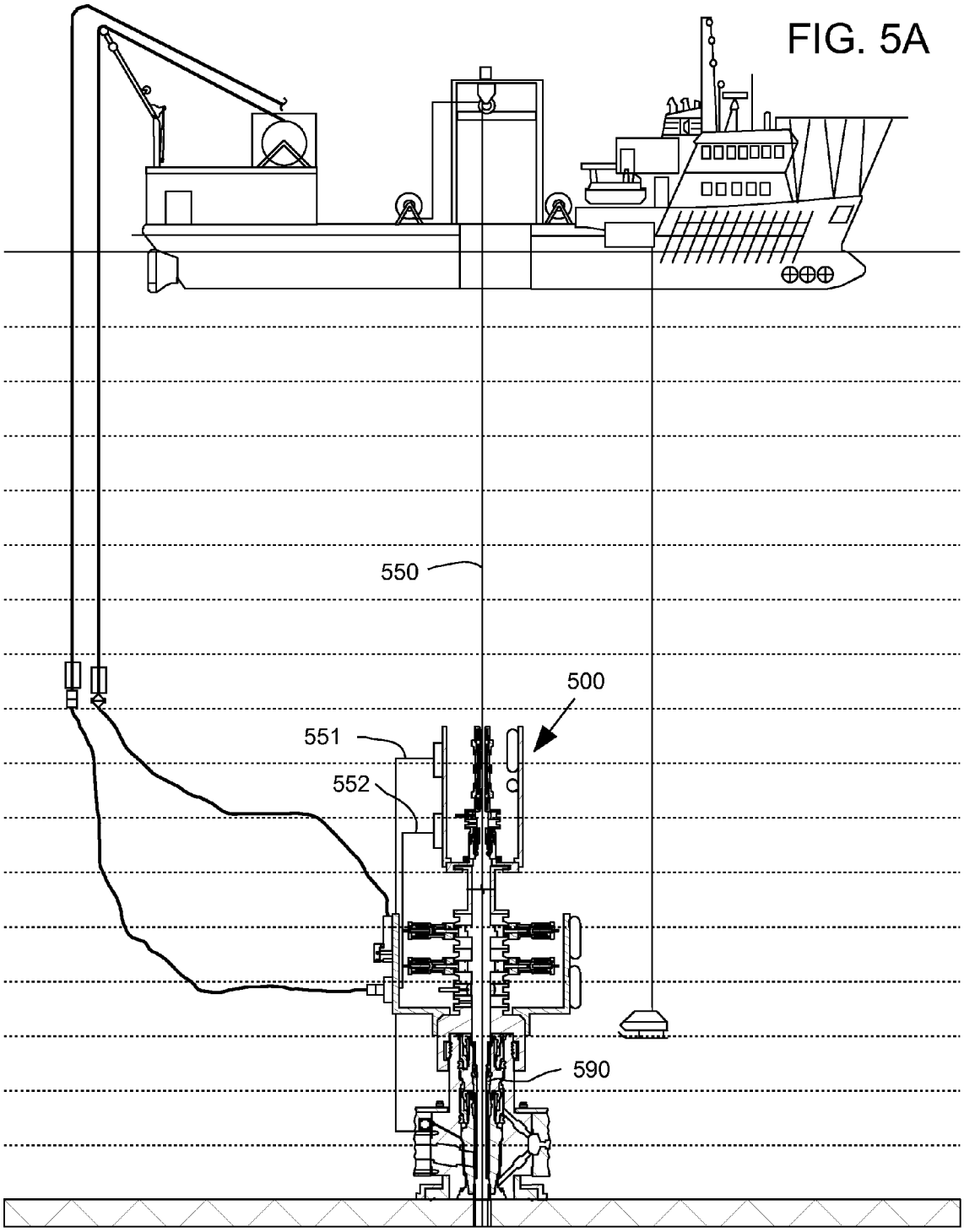
FIG. 5A illustrates an intervention operation being conducted using a wireline module connected to the PCA, according to another embodiment of the present invention.
Figure 5B:
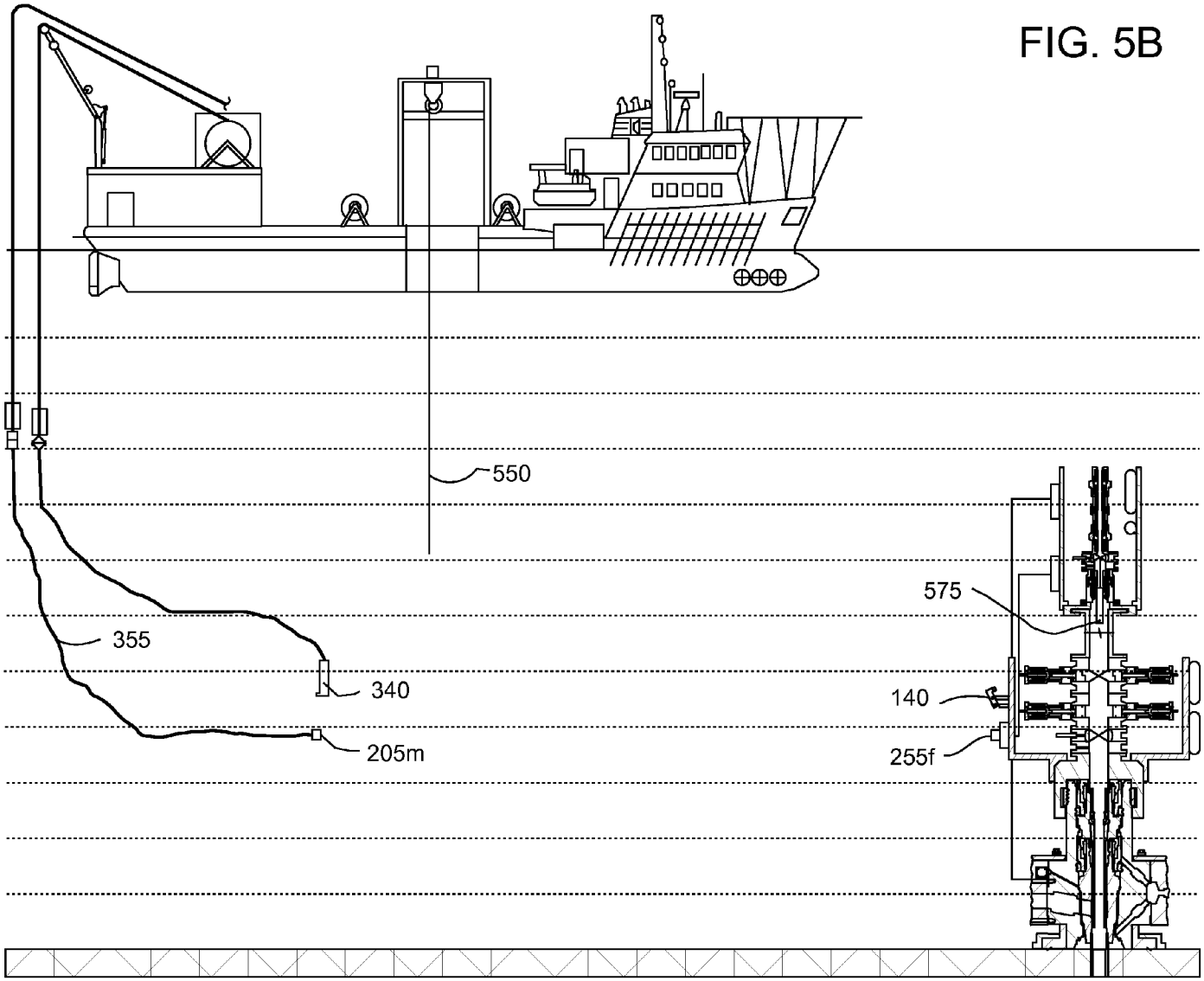
FIG. 5B illustrates emergency disconnection from the PCA in response to a minor emergency.
Figure 6:
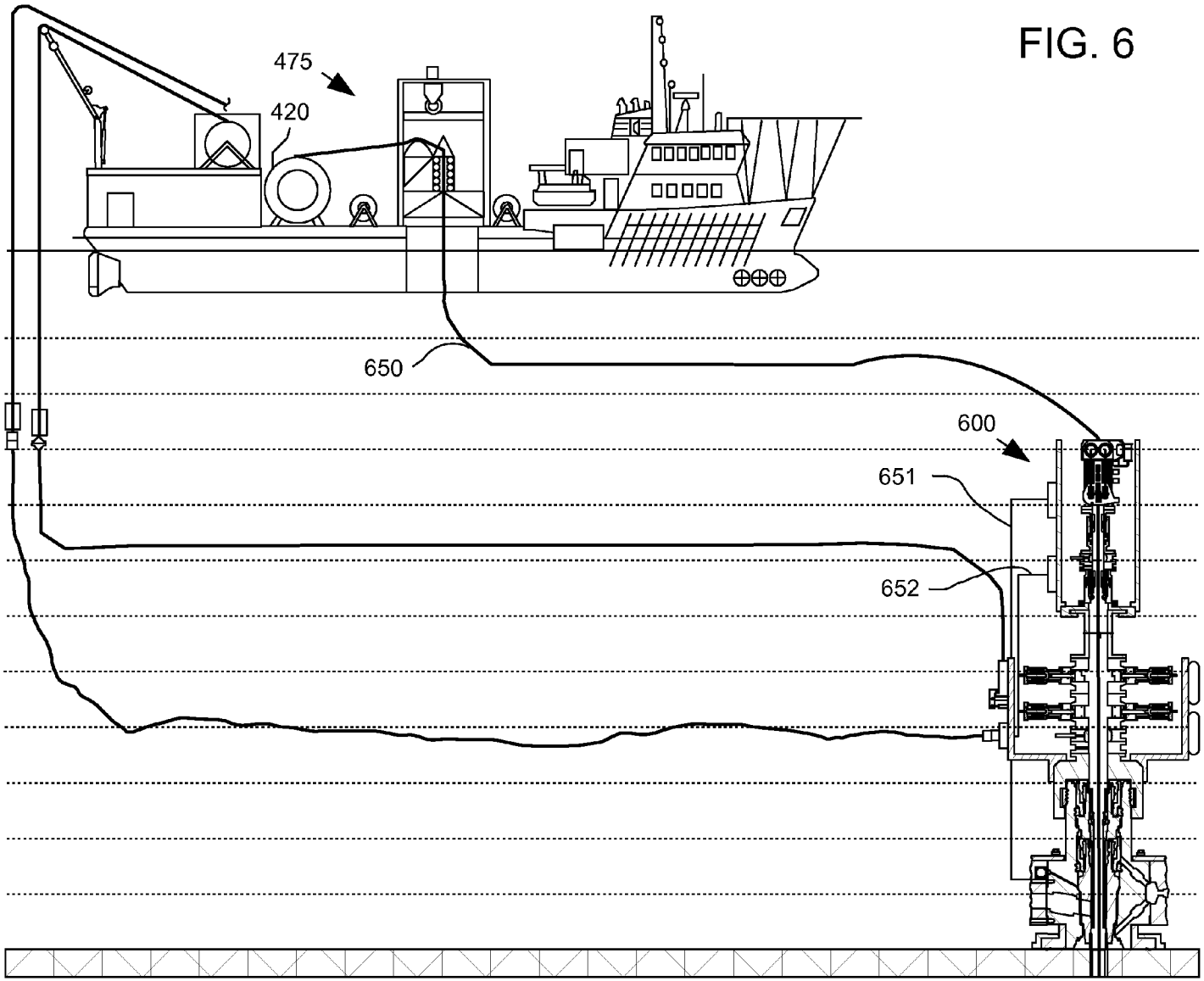
FIG. 6 illustrates an intervention operation being conducted using a coiled tubing module connected to the PCA, according to another embodiment of the present invention.

The tool housing 125 may be of sufficient length to contain either a plug running tool (PRT) (not shown) or a BHA 575 (FIG. 5B) so that the PCA 100 may be closed while deploying either a wireline module 500 (FIG. 5A) or a coiled tubing module 600 (FIG. 6.) The tool housing 125 may have a connector profile 125*c* for receiving an adapter of either workstring module 500, 600.

Figure 4A:
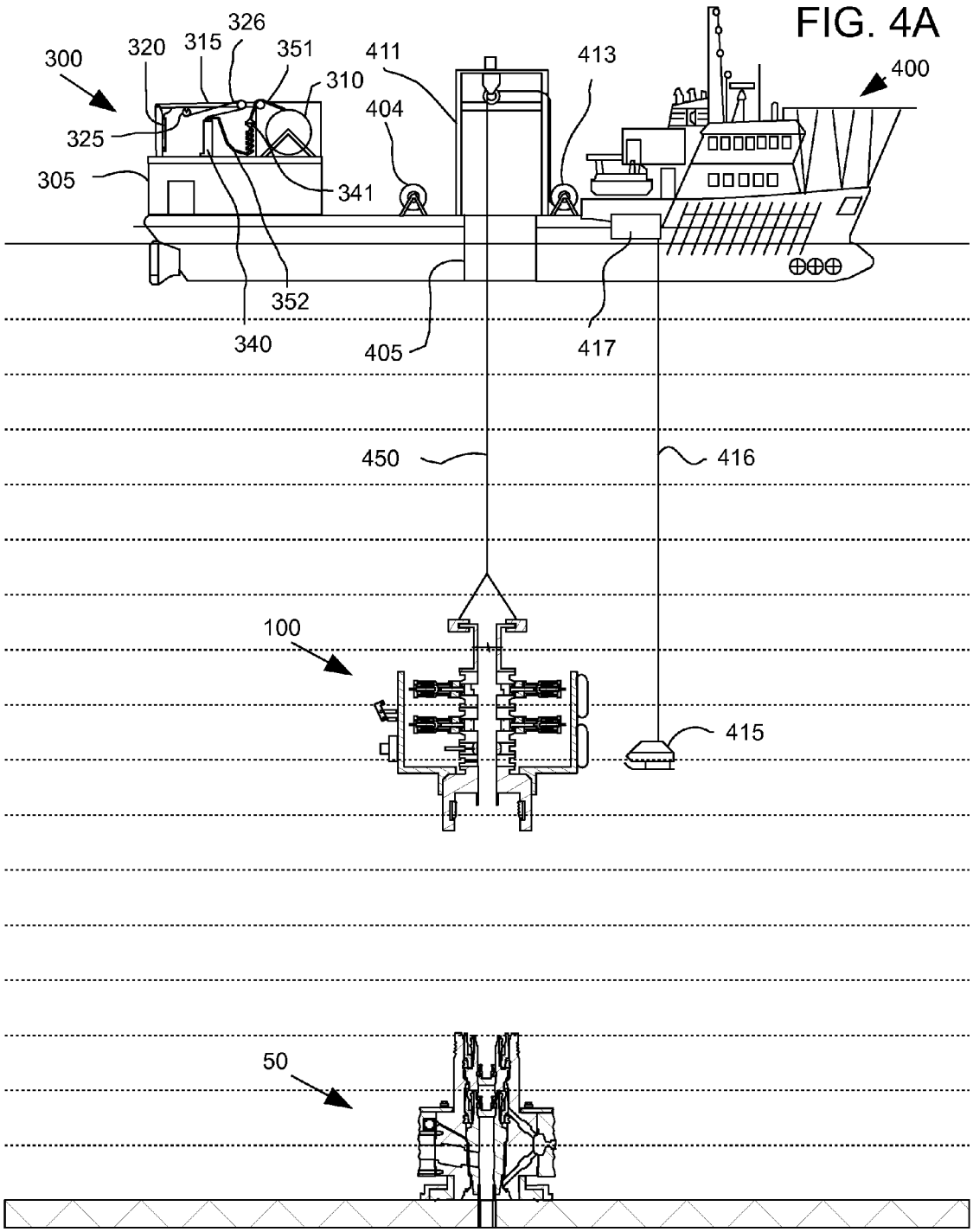
FIG. 4A illustrates deployment of the PCA to the subsea production tree, according to another embodiment of the present invention.

The pod receptacle 140 may be operable to receive a subsea control pod 340 (FIG. 4A). The receptacle may include a base 141, a latch 142, and an actuator 143. The base 141 be connected to the frame 130, such as by fasteners, and may include a landing plate for supporting the pod 340, a landing guide (not shown), such as a pin, and the stab plate. The stab plate may provide communication, such as electric (power and/or data), hydraulic, or optic, between the pod 340 and components of the PCA 100. The latch 142 may be pivoted to the base 141, such as by a fastener, and be movable by the actuator 143 between an engaged position (FIG. 4D) and a disengaged position (shown). The actuator 143 may be a piston and cylinder assembly connected to the frame 135 and the receptacle 140 may further include an interface (not shown), such as a hot stab, so that the ROV 415 may operate the actuator 143. The actuator 143 may also be in communication with the stab plate for operation by the pod 340. The latch 142 may include outer members and a crossbar 145 (FIG. 5C) connected to each of the outer members by a shearable fastener 144. The actuator 143 may be dual function so that the latch may be locked in either of the positions by either the pod 340 or the ROV 415.

Figure 4B:
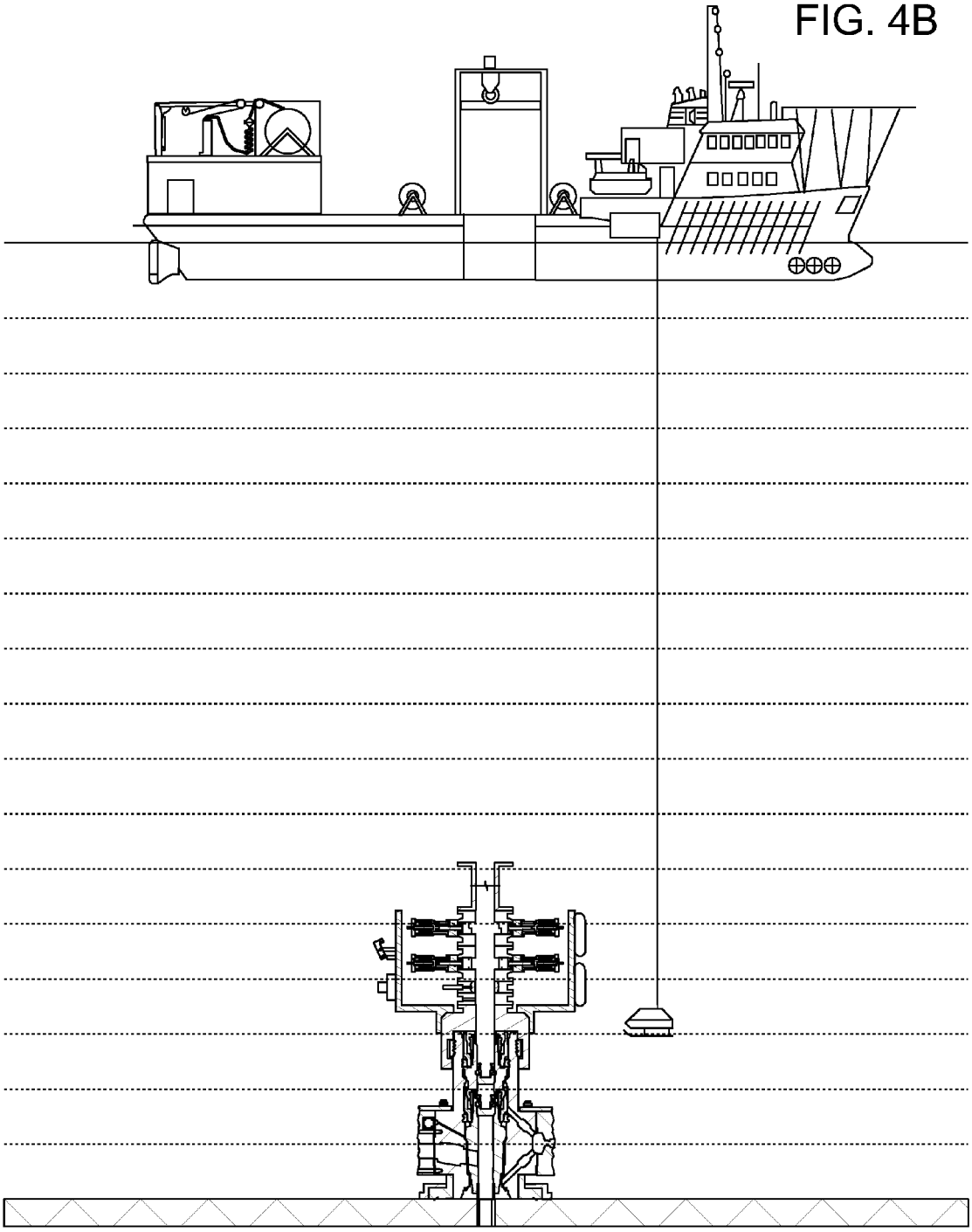
FIG. 4B illustrates connection of the PCA to the tree.
Figure 4C:
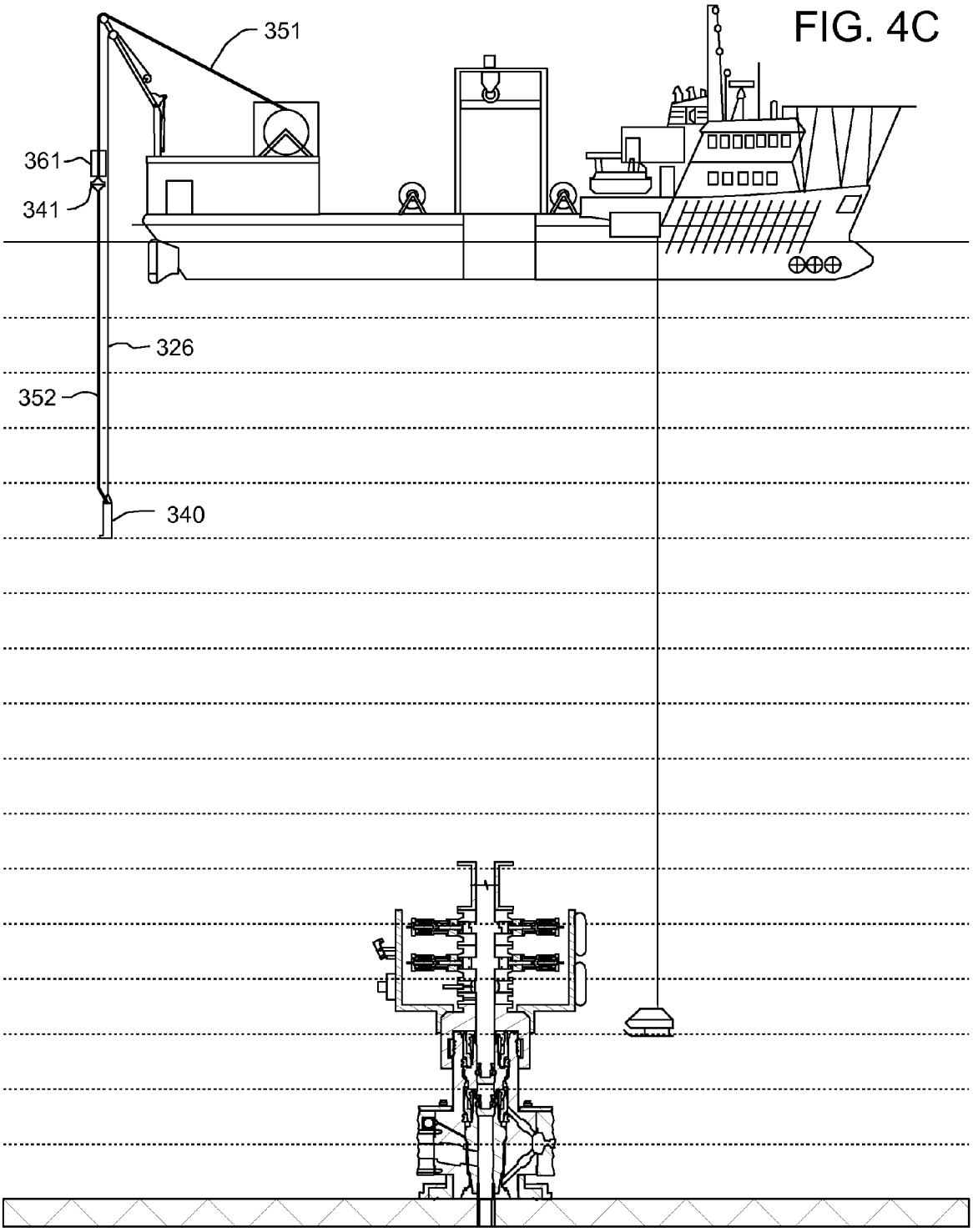
FIGS. 4C and 4D illustrate deployment of a control pod to the PCA using an umbilical.
Figure 4D:
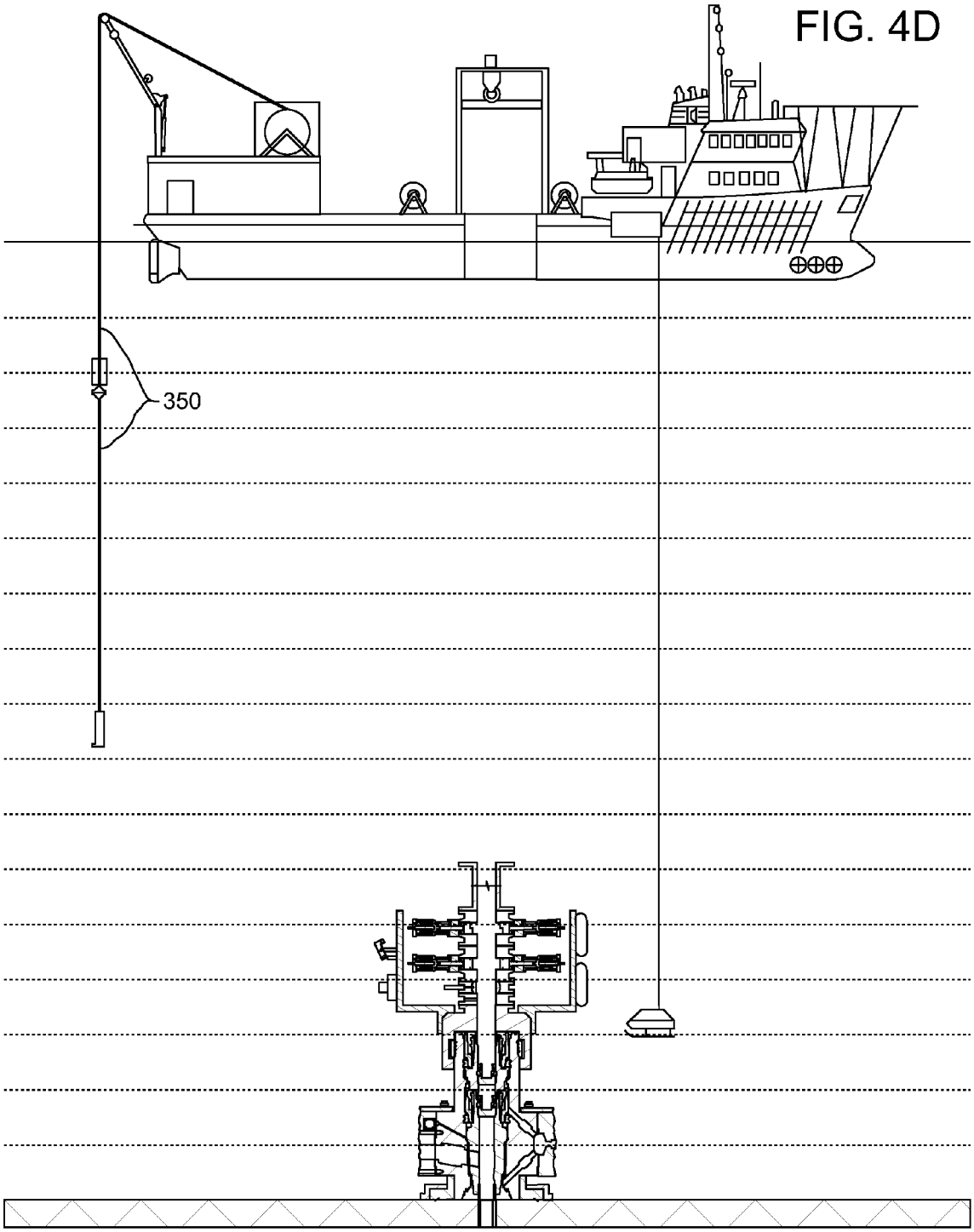

The control pod 340 may be in electric, hydraulic, and/or optic communication with a control van 305 onboard a support vessel 400 (FIG. 4A) via an umbilical 350 (FIG. 4D). The pod 340 may include one or more control valves (not shown) in communication with the BOP stack 120 (via the stab plate) for operating the BOP stack. Each control valve may include an electric or hydraulic actuator in communication with the umbilical 350. The umbilical 350 may include one or more hydraulic or electric control conduit/cables for each actuator. The accumulators 145 may store pressurized hydraulic fluid for operating the BOP stack 120. Additionally, the accumulators 145 may be used for operating one or more of the other components of the PCA 100. The accumulators 145 may be charged via a conduit of the umbilical 350 or by the ROV 415.

Figure 4E:
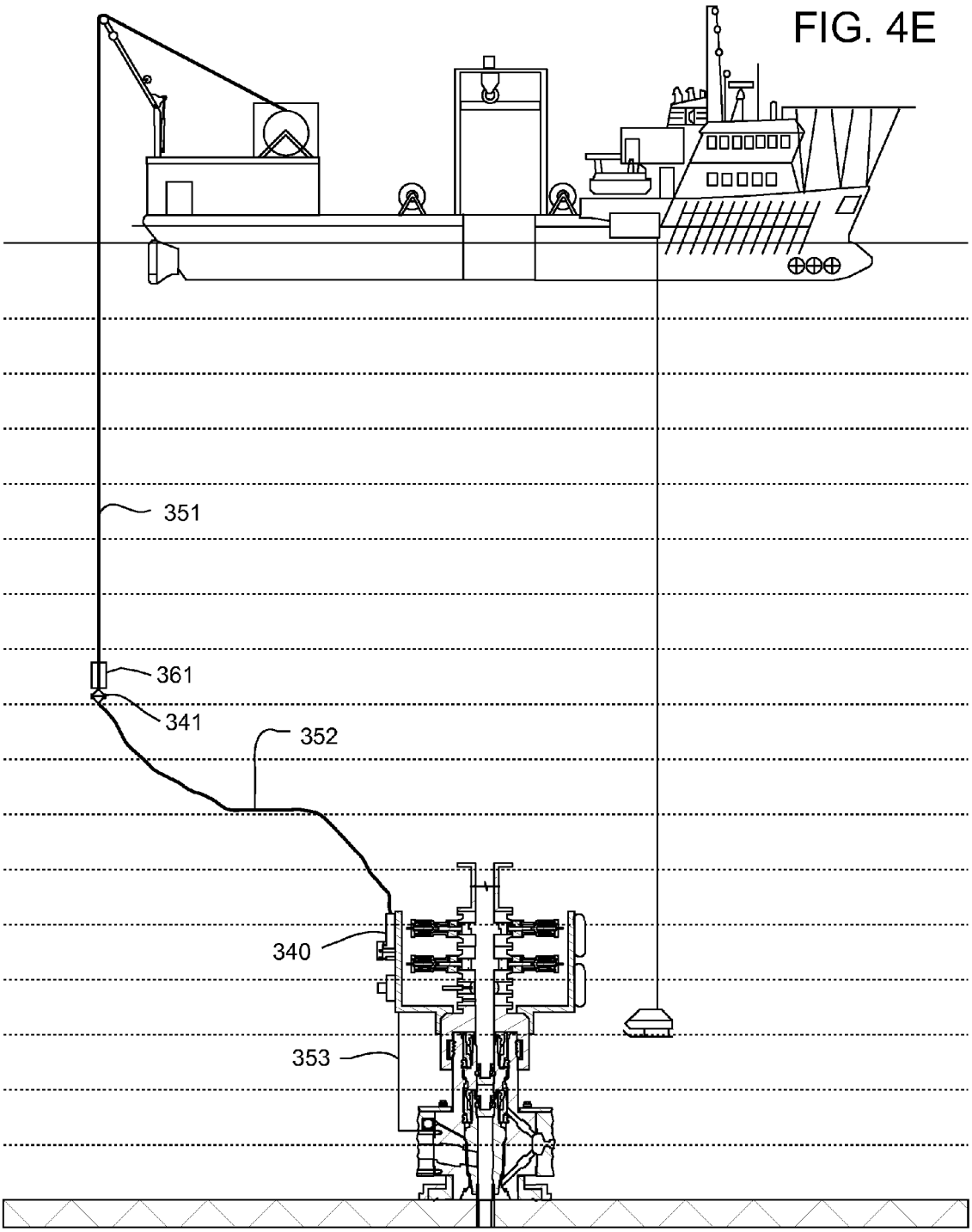
FIG. 4E illustrates connection of the control pod to the PCA.

The umbilical 350 may further include hydraulic, electric, and/or optic control conduit/cables for operating valves of the manifold 135, the actuators 115*a*, 143, tree valves 57*p,u,l* and the various functions of the workstring modules 500, 600 (discussed below). The stab plate may further include an output for the workstring modules 500, 600 and an output for the tree 50. Each output may include an ROV operable connector for receiving a respective jumper 353, 551, 651 (aka flying lead) (FIGS. 4E, 5A, and 6). The ROV 415 may connect the tree jumper 353 to a control panel (not shown) of the tree 50 and the workstring jumpers 551, 651 to a control relay of one of the workstring modules 500, 600. The umbilical 350 may further include one or more layers of armor (not shown) made from a high strength metal or alloy, such as steel, for supporting the umbilical's own weight and weight of the control pod 340.

The control pod 340 may further include a microprocessor based controller, a modem, a transceiver, and a power supply. The power supply may receive an electric power signal from a power cable of the umbilical 350 and convert the power signal to usable voltage for powering the pod components as well as any of the PCA components. The PCA 100 may further include one or more pressure sensors (not shown) in communication with the PCA bore at various locations. The workstring modules 500, 600 may also include one or more pressure sensors in communication with a respective bore thereof at various locations. The pressure sensors may be in data communication with the pod controller. The modem and transceiver may be used to communicate with the control van 305 via the umbilical 350. The power cable may be used for data communication or the umbilical 350 may further include a separate data cable (electric or optic). The control van 305 may include a control panel (not shown) so that the various functions of the PCA 100, the tree 50, and the workstring modules 500, 600 may be operated by an operator on the vessel 400.

The control pod 340 may also include a dead-man's switch (not shown) for closing the BOP stack 120 in response to a loss of communication with the control van 305. Alternatively, instead of having individual conduits/cables for controlling each function of the PCA 100, tree 50, and workstring modules 500, 600, the pod controller may receive multiplexed instruction signals from the van operator via a single electric, hydraulic, or optic control conduit/cable of the umbilical 350 and then operate the various functions using individual conduits/cables extending from the control pod 340.

The manifold 135 may include one or more actuated valves (not shown) and one or more couplings, such as dry break coupling 255*f*, for receiving a respective fluid conduit 355 (FIG. 4F) from the vessel 400. Actuators of the manifold valves and the couplings 255*f* may be in communication with the control pod 340 via the stab plate. Two fluid conduits 355 (only one shown) may extend from a vessel 400 to the manifold 135 for fluid circulation. A first one of the manifold valves may be in fluid communication with a first one of the couplings 255*f* and a fluid conduit extending to the port 110*p*. A second one of the manifold valves may be in fluid communication with a second one of the couplings (not shown) and another ROV operable connector for receiving a jumper 552, 652 (FIGS. 5A and 6) providing fluid communication with one of the junction plates of the workstring modules 500, 600.

Figures 3A, 3B, 3C:
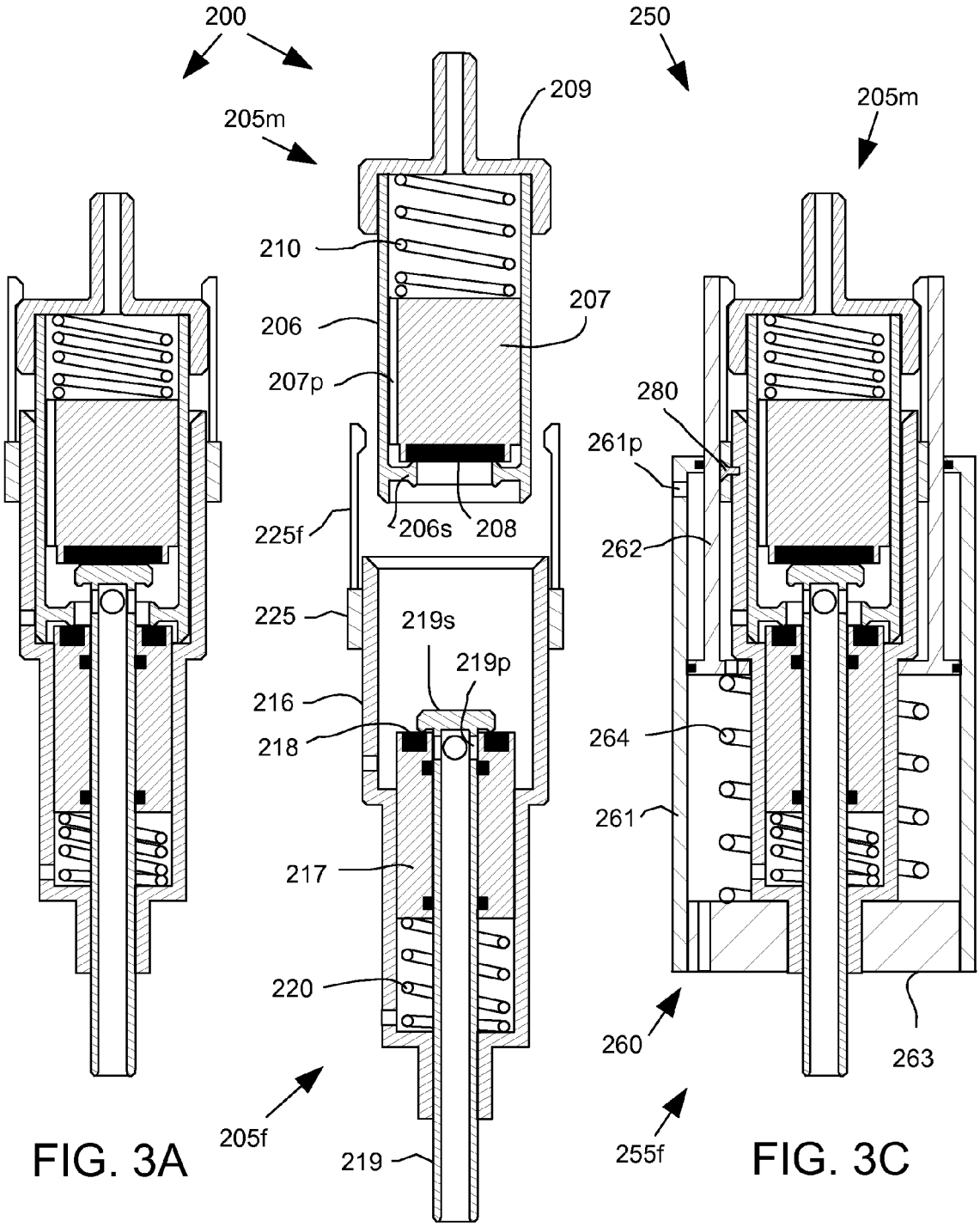
FIG. 3A illustrates a passive dry-break connection, according to another embodiment of the present invention.
FIG. 3B illustrates couplings of the connection disconnected.
FIG. 3C illustrates an actuated dry-break connection, according to another embodiment of the present invention.

FIG. 3A illustrates a passive dry-break connection 200, according to another embodiment of the present invention. FIG. 3B illustrates couplings 205*m,f* of the connection 200 disconnected. The connection 200 may include a male coupling 205*m* and a female coupling 205*f*.

The male coupling 205*m* may include a housing 206, a plug 207, a face seal 208, a cap 209, and a biasing member, such as a spring 210. A first end of the cap 209 may form a fitting and have a profile (not shown), such as a barb, thread, or flange, for connection to other parts of the fluid conduit 355 (discussed below). A second end of the cap 209 may connect to the housing 206, such as by a threaded connection (not shown). The plug 207 may be disposed in the housing and longitudinally movable relative thereto between an open position (FIG. 3A) and a closed position (FIG. 3B). The housing 206 may have a seat portion 206*s* extending radially inward from a cylindrical portion thereof. The face seal 208 may be disposed in a recess formed in a second end of the plug 207 and may be connected to the plug, such as by bonding, press fit, or molding. The spring 210 may be disposed in the housing 206 between the cap 209 and a first end of the plug 207. The spring 210 may bias the plug 207 toward the seat 206*s* and the face seal 208 may engage a first sealing surface of the seat in the closed position. The plug 207 may have one or more flow passages 207*p* formed therethrough. The passages 207*p* may be spaced around the plug 207 near an outer surface thereof. Alternatively, the passages 207*p* may each include a radial component so that the passages diverge from a center of the plug 207 at a first end to an outer surface of the plug at a second end to that flow bypasses the spring 210.

The female coupling 205*f* may include a housing 216, a plug 217, a face seal 218, a tappet 219, a biasing member, such as a spring 220, and a latch, such as a collet 225. A second end of the tappet 219 may form a fitting and have a profile (not shown), such as a barb, thread, or flange, for connection to other parts of the fluid conduit 355. The tappet 219 may be connected to the housing 216, such as by fasteners or a threaded connection (not shown). The plug 217 may be disposed in the housing 216 and longitudinally movable relative thereto between an open position (FIG. 3A) and a closed position (FIG. 3B). The tappet 219 may have one or more ports 219*p* formed through a wall thereof. The plug 217 may have a bore formed therethrough and the tappet may extend through the bore. A first end of the tappet 219 may form a seat 219*s*. The face seal 218 may be disposed in a recess formed in a first end of the plug 217 and may be connected to the plug, such as by bonding, press fit, or molding. The spring 220 may be disposed in the housing 216 between the housing and a second end of the plug 217. The spring 220 may bias the plug 217 toward the seat 219*s* and the face seal 218 may engage a second sealing surface of the seat in the closed position. The collet 225 may be disposed around the housing 216 and connected thereto, such as by a threaded connection and/or fasteners. The collet 225 may include a base and a plurality of split fingers 225*f* extending longitudinally from the base. The fingers 225*f* may have lugs formed at an end distal from the base.

To form the connection, the male 205*m* and female 205*f* couplings may be aligned and the couplings pushed together. As the couplings 205*m,f* are pushed, the tappet seat 219*s* may engage the male face seal 208 and push the male plug 207 away from the male housing seat 206*s* and against the male spring 210. Simultaneously, a second surface of the male housing seat 206*s* may engage the female face seal 218 and push the female plug 217 away from the tappet seat 219*s* and against the female spring 220. The male and female springs 210, 220 may each have a corresponding stiffness such that the plugs 207, 217 each move a corresponding amount. Also as the couplings 205*m,f* are pushed together, a first chamfered surface of the lugs may engage a chamfered surface at a second end of the cap 209, thereby pushing the fingers 225*f* radially outward. The couplings 205*m,f* may be pushed together until a second chamfered surface of the collet lugs engage another chamfered surface of the cap 209 at a shoulder of the cap, thereby allowing stiffness of the fingers 225*f* to return the fingers to their natural position. Engagement of a second end of the male housing 206 with a shoulder of the female housing 216 at or shortly after the fingers 225*f* return may serve as a rigid stop. The stiffness of the fingers 225*f* may resist separation due to pressure force and/or weight of the fluid conduit 355 but may allow separation of the couplings 205*m,f* in response to substantial tension exerted on the connection due to drift off or drive off of the vessel 400 in an emergency (discussed below).

FIG. 3C illustrates an actuated dry break connection 250, according to another embodiment of the present invention. The connection 250 may include the male coupling 205*m* and a female coupling 255*f*. The female coupling 255*f* may be similar to the female coupling 205*f* except that an actuator 260 has been added and the collet may be connected to the female housing by a shearable connection, such as one or more shear screws 280. The actuator 260 may include a housing 261, a piston 262, a nut 263, and a biasing member, such as a spring 264. The housing 261 may be connected to the nut 263, such as by a threaded connection (not shown). The nut 263 may be connected to the female housing, such as by a threaded connection (not shown). The piston 262 may be longitudinally movable relative to the housing between a locked position (shown) and an unlocked position (not shown). The spring 264 may be disposed between the nut 263 and the piston 262 and may bias the piston toward the locked position. A shoulder of the piston 262 may engage a shoulder of the female housing in the locked position. A sleeve portion of the piston 262 may engage an outer surface of the collet fingers in the locked position, thereby preventing disengagement of the fingers from the cap. A piston chamber may be formed between the housing 261 and the piston 262. A port 261*p* may be formed through the housing 261 and a hydraulic conduit (not shown) may connect to the port. The conduit may provide hydraulic communication between the port 261*p* and the stab plate for operation of the actuator by the control pod 340. Injection of hydraulic fluid into the chamber via the port 261*p* may move the piston 262 toward the nut 263 and against the spring 264 until the sleeve portion is clear of the fingers, thereby unlocking the fingers. Relief of the hydraulic fluid from the chamber via the port 261*p* may allow the spring 264 to return the piston 262 to the locked position. The stab plate/pod hydraulic circuit (not shown) may be dual-function so that the actuator 260 may be locked in either of the positions.

FIG. 4A illustrates deployment of the PCA 100 to the subsea production tree 50, according to another embodiment of the present invention. FIG. 4B illustrates connection of the PCA 100 to the tree 50. The support vessel 400 may be deployed to a location of the subsea tree 50. The support vessel 400 may be a light or medium intervention vessel and include a dynamic positioning system to maintain position of the vessel 400 on the waterline 1*w* over the tree 50 and a heave compensator (not shown) to account for vessel heave due to wave action of the sea 1. Alternatively, the vessel 400 may be a MODU. The vessel 400 may further include a tower 411 located over a moonpool 405 and a winch 413. The winch 413 may include a drum having wire rope 450 wrapped thereabout and a motor for winding and unwinding the wire rope, thereby raising and lowering a distal end of the wire rope relative to the tower. Alternatively, a crane (not shown) may be used instead of the winch and tower. The vessel 400 may further include a wireline winch 404.

The ROV 415 may be deployed into the sea 1 from the vessel 400. The ROV 415 may be an unmanned, self-propelled submarine that includes a video camera, an articulating arm, a thruster, and other instruments for performing a variety of tasks. The ROV 415 may further include a chassis made from a light metal or alloy, such as aluminum, and a float made from a buoyant material, such as syntactic foam, located at a top of the chassis. The ROV 415 may be controlled and supplied with power from vessel 400. The ROV 415 may be connected to support vessel 400 by an umbilical 416. The umbilical 416 may provide electrical (power), hydraulic, and/or data communication between the ROV 415 and the support vessel 400. An operator on the support vessel 400 may control the movement and operations of ROV 415. The umbilical 416 may be wound or unwound from drum 417.

The ROV 415 may be deployed to the tree 50. The ROV 415 may transmit video to the ROV operator for inspection of the tree 50. The ROV 415 may remove the external cap 55 from the tree 50 and carry the cap to the vessel 400. Alternatively, the winch 413 may be used to transport the external cap 55 to the waterline 1*w*. The ROV 115 may then inspect an internal profile of the tree 50. The wire rope 460*d* may then be used to lower the PCA 100 to the tree 50 through the moonpool 405 of the vessel 400. The ROV 415 may guide landing of the PCA 100 on the tree 50. The ROV 415 may then operate the adapter connector 105*d* to fasten the PCA 100 to the tree 50.

FIGS. 4C and 4D illustrate deployment of the control pod 340 to the PCA 100 using the umbilical 350. FIG. 4E illustrates connection of the control pod 340 to the PCA 100. The vessel 400 may further include a launch and recovery system (LARS) 300 for deployment of the control pod 340 and the umbilical 350. The LARS 300 may include a frame, an umbilical winch 310, a boom 315, a boom hoist 320, a load winch 325, and a hydraulic power unit (HPU, not shown). The LARS 300 may be the A-frame type (shown) or the crane type (not shown). For the A-frame type LARS 300, the boom 315 may be an A-frame pivoted to the frame and the boom hoist 320 may include a pair of piston and cylinder assemblies (PCAs), each PCA pivoted to each beam of the boom and a respective column of the frame. The HPU may include a hydraulic fluid reservoir, a hydraulic pump, and one or more control valves for selectively providing fluid communication between the reservoir, the pump, and the PCAs 320. The hydraulic pump may be driven by an electric motor.

The umbilical 350 may include an upper portion 351 and a lower portion 352 fastened together by a shearable connection 341. Each winch 310, 325 may include a drum having the respective umbilical upper portion 351 or load line 326 wrapped therearound and a motor for rotating the drum to wind and unwind the umbilical upper portion or load line 326. The load line 326 may be wire rope. Each winch motor may be electric or hydraulic. An umbilical sheave and a load sheave may each hang from the A-frame 315. The umbilical upper portion 351 may extend through the umbilical sheave and an end of the umbilical upper portion may be fastened to the shearable connection 341. The frame may have a platform for the control pod 340 to rest. The umbilical lower portion 352 may be coiled and have a first end fastened to the shearable connection 341 and a second end fastened to the control pod 340. The load line 351 may extend through the load sheave and have an end fastened to the lifting lugs of the control pod, such as via a sling. Pivoting of the A-frame boom 315 relative to the platform by the PCAs 320 may lift the control pod 340 from the platform, over a rail of the vessel 400, and to a position over the waterline 1*w*. The load winch 325 may then be operated to lower the control pod 340 into the sea 1.

A length of the umbilical lower portion 352 may be sufficient to provide slack to account for vessel heave. A length of the umbilical lower portion 352 may also be sufficient so that the shearable connection 341 is at or slightly above a depth of a top of the workstring modules 500,600 (FIGS. 5 and 6). A length of the load line 326 may correspond to the length of the umbilical lower portion 352. As the load winch 325 lowers the control pod 340, the umbilical lower portion 352 may uncoil and be deployed into the sea 1 until the shearable connection 341 is reached. Once the shearable connection 341 is reached, a clump weight 361 may be fastened to a lower end of the umbilical upper portion 351. The control pod 340 may continue to be lowered using the load winch 325 until the shearable connection 341 and clump weight 361 are deployed from the LARS platform to over the waterline 1*w*. The umbilical winch 351 may then be operated to support the control pod 340 using the umbilical 350 and the load line 326 slacked. The load line 326 and sling may be disconnected from the control pod 340 by the ROV 415. Alternatively, the load line 326 may be wireline and the sling may have an actuator in communication with the wireline so that the van operator may release the sling. The control pod 340 may then be lowered to a landing depth (clump weight 361 and shearable connection 341 at or above top of workstring module 500, 600) using the umbilical winch 310.

The PCA 100 may be deployed with the latch 142 locked in the disengaged position. Alternatively, the ROV 415 may operate the actuator 143 to disengage the latch after the PCA 100 has landed. As the pod 340 is being lowered to the landing depth, the ROV 415 may grasp the control pod and assist in landing the control pod 340 in the receptacle 140. Once landed, the ROV 415 may engage the latch 142 with the pod 340. The ROV 415 may then connect the jumper 353 to the tree control panel. The operator in the control van 305 may then close then close the tree valves 57*u,l,p* and the SSV via the umbilical 350.

Figure 4F:
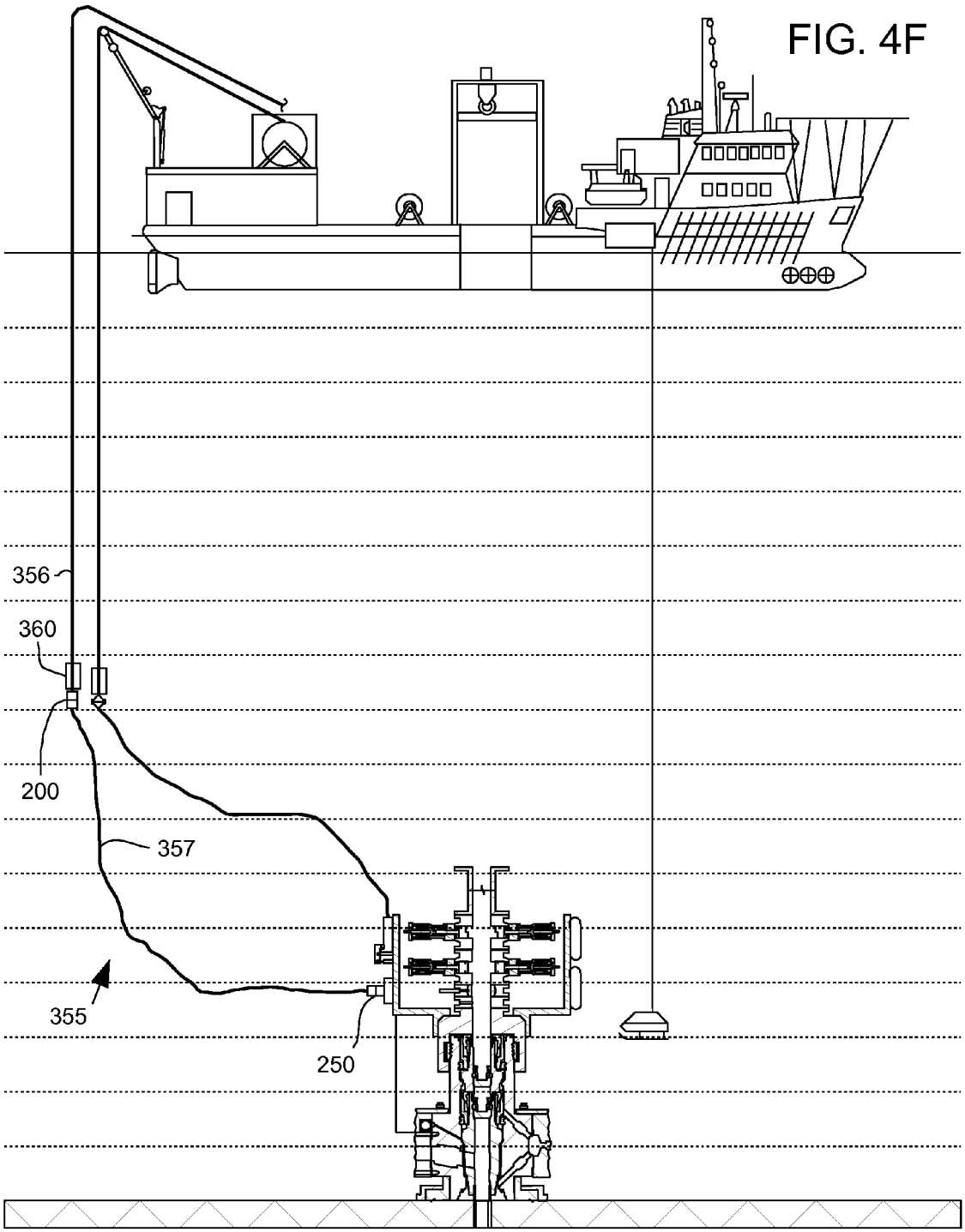
FIG. 4F illustrates deployment and connection of a fluid conduit to the tree.

FIG. 4F illustrates deployment and connection of a fluid conduit 355 to the tree. An upper portion of each fluid conduit 355 may be coiled tubing 356. The vessel 400 may further include a coiled tubing unit (CTU, not shown) for each fluid conduit 355. Each CTU may include a drum having the coiled tubing 356 wrapped therearound, a gooseneck, and an injector head for driving the coiled tubing 356, controls, and an HPU. Alternatively, each CTU may be electrically powered. A lower portion of each fluid conduit 355 may include a hose 357. The hose 357 may be made from a flexible polymer material, such as a thermoplastic or elastomer or may be a metal or alloy bellows. The hose 357 may or may not be reinforced, such as by metal or alloy cords. An upper end of the hose 357 may be connected to the coiled tubing 356 by the passive dry beak connection 200 and a lower end of the hose 357 may have the male coupling 205*m* (of the actuated connection 250) connected thereto. The hose 357 may include two or more sections (only one section shown), each section fastened together, such as by a flanged or threaded connection. During deployment of the fluid conduit 355, a clump weight 360 may be fastened to the lower end of the coiled tubing 356.

The lower portion 357 of the fluid conduit 355 may be assembled on the vessel 400 and deployed into the sea 1 using the CTU. The coiled tubing 356 may be deployed until the clump weight 360 and passive dry break connection 200 are at or slightly above a depth of a top of the workstring modules 500,600. The ROV 415 may then grasp the male coupling 205*m* of the actuated connection 250 and guide the coupling to the manifold 135. A length of the hose 357 may be sufficient to provide slack in the fluid coupling 355 to account for vessel heave. The van operator may operate the actuator 260 to the unlocked position. The ROV 415 may then insert the male coupling 205*m* into the female coupling 255*f* and the van operator may lock the connection 250. The operation may then be repeated for the second fluid conduit.

FIG. 5A illustrates an intervention operation being conducted using a wireline module 500 connected to the PCA 100, according to another embodiment of the present invention. For a more detailed view of the wireline module 500, see FIG. 2B of U.S. patent application Ser. No. 13/018,871, filed Feb. 1, 2011 (Atty. Dock. No. WWCI/0011US), which is herein incorporated by reference in its entirety. The wireline module 500 may include an adapter, a fluid sub, an isolation valve, one or more stuffing boxes, a grease injector, a frame, a control relay, an interface, such as a junction plate, a grease reservoir, a grease pump, and a tool catcher. The adapter, fluid sub, isolation valve, stuffing boxes, grease injector, and tool catcher may each include a housing or body having a longitudinal bore therethrough and be connected, such as by flanges, such that a continuous bore is maintained therethrough.

The adapter may include a connector for mating with the connector profile 125*c*, thereby fastening the wireline module 500 to the PCA 100. The connector may be dogs or a collet. The adapter may further include a seal face or sleeve and a seal. The adapter may further include an actuator, such as a piston and a cam, for operating the connector. The adapter may further include an ROV interface so that the ROV 415 may connect to the connector, such as by a hot stab, and operate the connector actuator. Alternatively, the adapter may have the connector profile instead of the connector and the tool housing may have the connector in communication with the control pod for operation by the van operator. The fluid sub may include a housing having a bore therethrough and a port in communication with the bore. The port may be in fluid communication with the junction plate via a conduit. The frame may be fastened to the adapter and the relay and interface may be fastened to the frame. The pump and reservoir may also be fastened to the frame.

The isolation valve may include a housing, a valve member disposed in the housing bore and operable between an open position and a closed position, and an actuator operable to move the valve member between the positions. The actuator may be electric or hydraulic and may be in communication with the control relay via a conduit. The actuator may fail to the closed position in the event of an emergency. The isolation valve may be further operable to cut the wireline 550 when closed or the wireline module 500 may further include a separate wireline cutter. The isolation valve may further operate as a check valve in the closed position: allowing fluid flow downward from the stuffing box toward the PCA 100 and preventing reverse fluid flow therethrough.

Each stuffing box may include a seal, a piston, and a spring disposed in the housing. A port may be formed through the housing in communication with the piston. The port may be connected to the control relay via a hydraulic conduit, not shown. When operated by hydraulic fluid, the piston may longitudinally compress the seal, thereby radially expanding the seal inward into engagement with the wireline 550. The spring may bias the piston away from the seal and be set to balance hydrostatic pressure. Alternatively, an electric actuator may be used instead of the piston.

The grease injector may include a housing integral with the stuffing box housing and one or more seal tubes. Each seal tube may have an inner diameter slightly larger than an outer diameter of the wireline, thereby serving as a controlled gap seal. An inlet port and an outlet port may be formed through the grease injector/stuffing box housing. A grease conduit may connect an outlet of the grease pump with the inlet port and another grease conduit may connect the outlet port with the grease reservoir. Another grease conduit may connect an inlet of the pump to the reservoir. Alternatively, the outlet port may discharge into the sea 1. The grease pump may be electrically or hydraulically driven via cable/conduit connected to the control relay and may be operable to pump grease from the grease reservoir into the inlet port and along the slight clearance formed between the seal tube and the wireline 550 to lubricate the wireline, reduce pressure load on the stuffing box seals, and increase service life of the stuffing box seals. The grease reservoir may be recharged by the ROV 415.

The tool catcher may include a piston, a latch, such as a collet, a stop, a piston spring, and a latch spring disposed in a housing thereof. The collet may have an inner cam surface for engagement with a fishing neck of the PRT and/or BHA and the catcher housing may have an inner cam surface for operation of the collet. The latch spring may bias the collet toward a latched position. The collet may be movable from the latched position to an unlatched position either by engagement with a cam surface of the fishing neck and relative longitudinal movement of the fishing neck upward toward the stop or by operation of the piston. Once the cam surface of the fishing neck/BHA has passed the cam surface of the collet, the latch spring may return the collet to the latched position where the collet engages a shoulder of the fishing neck, thereby preventing longitudinal downward movement of the PRT/BHA relative to the catcher. The catcher housing may have a hydraulic port formed through a wall thereof in fluid communication with the piston. A hydraulic conduit (not shown) may connect the hydraulic port to the control relay. The piston may be biased away from engagement with the collet by the piston spring. When operated, the piston may engage the collet and move the collet upward along the housing cam surface to a latched position. Alternatively, an electric actuator may be used instead of the piston.

To prepare for intervention (or abandonment), the wireline 550 may be fed through the tower 411 and inserted through the wireline module 500 and connected to the PRT. The PRT may then be connected to the tool catcher. The wireline module 500 may then be deployed through the moonpool 405 using the wireline winch 404 and landed on the tool housing 125. The ROV 415 may operate the adapter connector, thereby fastening the wireline module 500 to the PCA 100. The ROV 415 may then connect jumper 551 to the control pod 340 and control relay and connect fluid conduit 552 to the manifold 135 and the junction box. The van operator may then engage one or both of the stuffing boxes with the wireline 550. The van operator may then release the PRT from the tool catcher via the umbilical 350 and control relay. The PRT may be lowered to the upper crown plug 56*u* and operated to engage the upper crown plug by sending a signal through electrical conductors of the wireline 550. The PRT and upper crown plug 56*u* may then be raised until the PRT reengages the tool catcher. The wireline module isolation valve may then be closed. The PRT and upper crown plug 56*u* may then be washed by injecting a hydrates inhibitor from the vessel 400, through the fluid conduit 355, the manifold, the conduit 551, the junction plate, and into the wireline module port. The spent inhibitor may be returned to the vessel 400 through the port 110*p*, the manifold 135, and the second fluid conduit (as discussed above, isolation valve 115 may allow downward flow when closed or the PCA 100 may include a bypass). Once washing is complete, the blind-shear preventer 120*b* may also be closed. The adapter connector may then be released by the ROV 415 and the wireline module 500 and upper crown plug 56*u* may be retrieved to the vessel 400. The operation may then be repeated for the lower crown plug 56.

The wireline module 500 and PRT may then be deployed again with a tree saver 590 (see FIG. 4F of the '871 application for more detail). The tree saver 590 may include a sleeve with a metal seal on its outer surface. The metal seal may be a depending lip that engages a tapered inner surface of the internal tree cap 54. Alternatively, the tree saver metal seal may engage the tubing hanger 53 instead of the tree cap 54. The sleeve may have a plurality of windows which allow fasteners, such as dogs, to extend and retract. The dogs may be pushed outward by an actuator, such as a central cam. The cam may have a profile on its upper end. The cam may move between a lower locked position and an upper position freeing dogs to retract. A retainer may secure to the upper end of body to retain the cam. The tree saver 590 may further include one or more seals. The seals may each be made from a polymer, such as an elastomer. The sleeve may have a length sufficient to extend past the production passage and the lower seal may engage an inner surface of the tubing hanger 53, thereby isolating the production passage from any harmful fluids used during the intervention operation, such as cement or fracing fluid. Alternatively, the sleeve may extend into the production tubing 10*p* and the lower seal may engage an inner surface of the production tubing. The sleeve may also extend upward to the tree adapter 105 and the upper seal may engage an inner surface of the adapter sleeve 105*s*. Alternatively, the sleeve portion extending from the dogs to the tree connector and the upper seal may be omitted.

Once the tree saver 590 has been installed, the wireline module 500 may be redeployed and landed on the PCA 100 with the BHA 575 for the intervention (or abandonment) operation. The BHA 575 may then be lowered into the wellbore.

FIG. 5B illustrates emergency disconnection from the PCA 100 in response to a minor emergency, according to another embodiment of the present invention. A minor emergency may include a minor equipment failure on the vessel 400, such as failure of the dynamic positioning system, general power failure of the vessel, or requirement to quickly depart from the wellsite, such as due to inclement weather. Assuming communication between the control van 305 and the control pod 340 is intact (i.e., the vessel 400 has at least emergency power). The BHA 575 may be retrieved into engagement with the tool catcher. The wireline isolation valve may be closed, thereby severing the wireline 550. The PCA isolation valve and the blind ram BOP may then be closed. The disconnect actuator 260 may then be moved to the disengaged position and locked in the disengaged position. The receptacle actuator 143 may then move the latch 142 to the disengaged position and be locked in the disengaged position. As the vessel 400 drifts or drives off, tension may be exerted on the dry break connection 250 by the fluid conduit 355, thereby pulling the male coupling 205*m* from the female coupling 255*f*, and tension may be exerted on the control pod 340 by the umbilical 350, thereby lifting the control pod from the receptacle 140. The vessel 400 may then be free to drift or drive off from the wellsite.

Figure 5C:
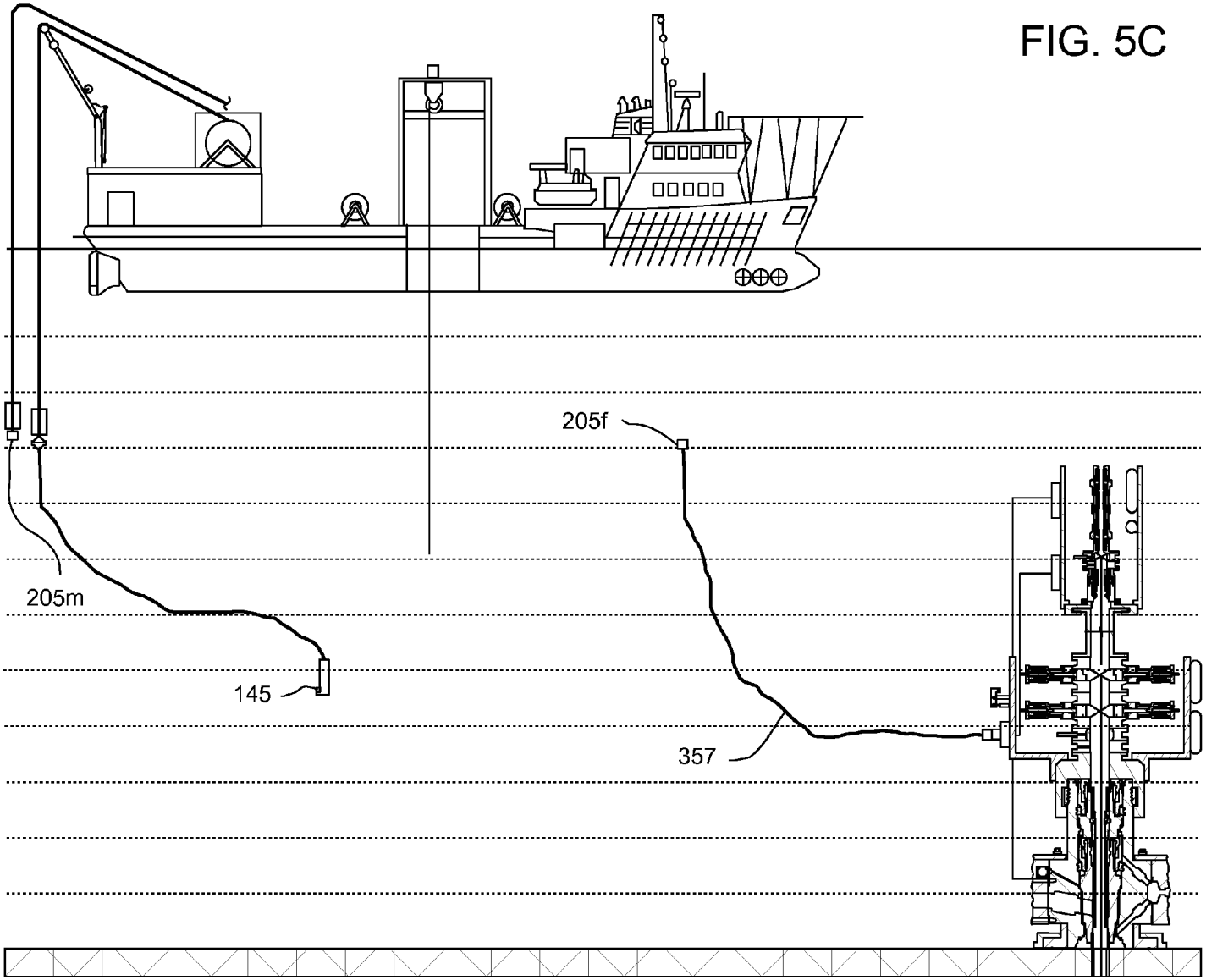
FIG. 5C illustrates emergency disconnection from the PCA in response to a major emergency.

FIG. 5C illustrates emergency disconnection from the PCA 100 in response to a major emergency, according to another embodiment of the present invention. A major emergency may include a major equipment failure on the vessel 400 and/or incapacitation of the vessel crew, such as due to a fire and/or explosion on the vessel caused by a blowout from the wellbore 10 or severe storm. The dead-man switch may detect loss of communication with the van 305. The dead-man switch may then close the BOPs 120*b,w*, thereby cutting the wireline 550. One of the BOPs 120*b,w* may also be configured to grab and hold the wireline 550 so that the BHA 575 does not drop to the bottom of the wellbore 10. The wireline isolation valve may be closed, thereby again cutting the wireline 550. As the vessel 400 drifts off, tension may be exerted on the passive dry break connection 200 by the fluid conduit 355, thereby pulling the male coupling 205*m* from the female coupling 205*f*, and tension may be exerted on the control pod 340 by the umbilical 350, thereby shearing the latch fastener 144. If the passive connection 200 fails to disconnect, then the shear screw 280 may release the male coupling 205*m* and collet from the female coupling 255*f*.

If the latch fastener 144 fails to shear and/or the control pod 340 and umbilical lower portion 352 become entangled with the PCA 100 and/or wireline module 500, then the shearable coupling 341 may disconnect the umbilical upper portion 351 from the control pod 340 and umbilical lower portion 352. The vessel 400 may then be free to drift off from the wellsite. The clump weights 360, 361 may each maintain tension in the respective coiled tubing 356 and umbilical upper portion 351 such that lateral spacing among the coiled tubing 356, umbilical upper portion 351, and wireline 550 remains constant, thereby ensuring no contact or entanglement between them. Having the landing depth of the clump weights 360, 361 and adjacent respective dry break coupling 200 and shearable connection 341 at or above a depth of the top of the wireline module 500 ensures no entanglement of the respective coiled tubing 356 and umbilical upper portion 351 with the PCA 100 and/or wireline module.

Regarding the dry break connections 200, 250, the collet of the passive connection may have a stiffness greater or substantially greater than the actuated connection so that the when the actuated connection is unlocked, the actuated connection may require less or substantially less tension to release. The shear screw(s) 280 may require a greater or substantially greater tension than the passive collet to separate so that the passive connection 200 may separate before the actuated connection 250 (when locked). The tension to shear the shear screws 280 may be less or substantially less than a minimum tensile strength of the fluid conduit 355 (i.e., a tensile strength of the hose 357).

Regarding the pod receptacle shearable fasteners 144 and the shearable connection 341, the shearable connection 341 may release at a greater or substantially greater tension than required to release the shearable fasteners 144. The tension required to release the shearable connection 341 may be less or substantially less than a tensile strength of the umbilical 350 and greater or substantially greater than a weight of the control pod 340.

FIG. 6 illustrates an intervention operation being conducted using a coiled tubing module 600 connected to the PCA 100, according to another embodiment of the present invention. For a more detailed view of the coiled tubing module 600, see FIG. 2C of the '871 application. The coiled tubing module 600 may be deployed instead of the wireline module 500 to conduct the intervention or abandonment operation. The coiled tubing module 600 may include an adapter, a fluid sub, an isolation valve, a stripper, a subsea coiled tubing injector, a frame, a control relay, an interface, such as a junction plate, and a tool catcher. The adapter, fluid sub, isolation valve, stripper, and tool catcher may each include a housing or body having a longitudinal bore therethrough and be connected, such as by flanges, such that a continuous bore is maintained therethrough. The adapter may be similar to the wireline adapter. The frame may be fastened to the adapter and the relay and the interface may be fastened to the frame. The fluid sub may include a housing having a bore therethrough and a port in communication with the bore. The port may be in fluid communication with the junction plate via a conduit (not shown). The tool catcher may be similar to the wireline tool catcher.

The isolation valve may include a housing, a valve member disposed in the housing bore and operable between an open position and a closed position, and an actuator operable to move the valve member between the positions. The actuator may be electric or hydraulic and may be in communication with the control relay via a conduit (not shown). The actuator may fail to the closed position in the event of an emergency. The isolation valve may be further operable to cut coiled tubing 650 when closed or the coiled tubing module 600 may further include a separate coiled tubing cutter. The isolation valve may further operate as a check valve in the closed position: allowing fluid flow downward from the stripper toward the PCA 100 and preventing reverse fluid flow therethrough.

The stripper may include a seal and a piston disposed in the housing. A hydraulic packoff port and a hydraulic release port may be formed through the housing in fluid communication with a respective face of the piston. Each port may be connected to the control relay via a respective hydraulic conduit. When operated by pressurized hydraulic fluid via the pack-off port, the piston may longitudinally compress the seal, thereby radially expanding the seal inward into engagement with the coiled tubing. The seal may be released by application of pressurized hydraulic fluid via the release port. Alternatively, an electric actuator may be used instead of the piston. Alternatively, the stripper may include a spring instead of the release port.

The injector may include a traction assembly to engage the coiled tubing 650 and drive the coiled tubing into or out of the wellbore 10. The traction assembly may include opposing chain loops guided by bearing assemblies. Gripping members may be secured to individual links of the chain loops, so as to grip the coiled tubing. The gripping members and the chain loops may thus move together longitudinally at the area of contact with the coiled tubing 650 to move the coiled tubing into or out of the wellbore 10. A plurality of rollers may be secured to the links of the chain loops, and roll along support members. The support members may be moved laterally inwardly to urge the gripping members into engagement with the coiled tubing 650 with sufficient force to grip the coiled tubing. The rollers may allow for a large lateral load to be applied without inducing a significant longitudinal drag load.

The bearing assemblies and an injector gear case may both be sealed to retain lubricant and prevent intrusion of seawater. The bearing assemblies may be outboard bearing assemblies because the portion of the housing adjacent the sealed gear case may be open to seawater to accommodate the chain loops. The chain loops may be routed over sprockets or gears within the housing, rotating about the axis of the bearings assemblies, and the chain loops may thus be guided by the bearing assemblies. A hydraulic or electric drive motor may drive the chain loops. The drive motor may be in hydraulic/electric communication with the control relay via a conduit/cable. The gear case may house a plurality of gears which may be driven by the drive motor and which may drive the chain loops via a drive shaft sealably extending from the sealed gear case.

The injector may further include a lubricant reservoir. The reservoir may compensate pressure within the gear case, each outboard bearing assembly, and other components of the injector that are sealed and sensitive to pressure differentials, such as the rollers. The reservoir may include a housing structurally separate from and attached to an outer housing of the gear case. The reservoir housing may be divided into a compensator chamber and a lubricant chamber by a pressure compensator, such as a piston or diaphragm. The lubricant chamber maybe filled with a lubricant. A conduit may be used to fluidly connect and pass lubricant between the reservoir and the gear case, the bearing assemblies, the rollers, and other sealed components. The compensator chamber may be in fluid communication with the sea by a port formed through the reservoir housing. As the hydrostatic pressure surrounding the reservoir increases, such as when the injector is lowered into a subsea environment, the compensator may pressurize the lubricant, thereby equalizing or substantially equalizing the lubricant pressure and the hydrostatic seafloor pressure. The compensator may be biased so that the lubricant pressure is slightly greater than the seafloor pressure. Accordingly, the pressure differential that would otherwise exist between the seawater environment and the interior of the sealed components is reduced or eliminated.

The vessel 400 may further include an additional CTU (second or third) including injector head 475, drum 420, gooseneck, and HPU (not shown). The coiled tubing 650 may be inserted through the coiled tubing module 600 and connected to the BHA (not shown). The BHA may include one or more tools operable to perform an intervention or abandonment operation in the wellbore 10. The BHA may then be connected to the tool catcher. The injector head 475 may be deployed over the moon pool 405 and the coiled tubing module may be lowered to the tree 50 using the vessel injector and the coiled tubing.

Once the coiled tubing adapter has landed onto the PCA 100, the ROV 415 may operate the adapter connector, thereby fastening the coiled tubing module to the PCA 100. The ROV 415 may then connect a jumper 651 to the control pod 340 and control relay and connect fluid conduit 652 to the manifold 135 and the junction box. Once fastened, the vessel injector 475 may feed the coiled tubing 650 toward the tree 50, thereby creating slack in the coiled tubing 650. The vessel 400 may then (or simultaneously) be moved a distance from the tree 50 ensuring safety of the vessel 400 should a blowout occur during the intervention operation. The slack may also serve to compensate for heave of the vessel.

The stripper may be engaged with the coiled tubing by the vessel operator and then the isolation valve, blind-shear BOP 120*b*, and SSV may be opened. The van operator may then release the BHA from the tool catcher via the umbilical 350 and control relay. The subsea drive motor may then be operated by the van operator, thereby advancing the BHA toward the tree 50. The slack may be maintained through synchronization of the vessel injector with the subsea injector by communication with the surface controller. The coiled tubing 650 may continue be advanced (while maintaining the slack via synchronous operation of the vessel injector) into the wellbore 10 by the subsea injector until the BHA reaches a desired depth in the wellbore. The intervention or abandonment operation may then be conducted using the coiled tubing and the BHA. To facilitate the intervention or abandonment operation, fluid may be pumped through the coiled tubing 650 and the BHA and returned to the vessel 400 via the port 110*p*. Further, fluid may be pumped into the wellbore 10 before or after deployment of the BHA through the port 110*p* with the isolation valve 115 closed, thereby protecting the BOP stack 120 from the fluid.

The emergency disconnect system (EDS) may also facilitate deployment of the coiled tubing 650 with slack, especially for shallow wellheads (i.e., at a depth of less than or equal to one thousand feet) by reducing risk of entanglement of the umbilical 350 and/or fluid conduit(s) 355 with the coiled tubing module 600 or PCA 100 should an emergency occur. The EDS may function for the coiled tubing module 600 similarly as for the wireline module 500, discussed above.

Once the intervention or abandonment operation has concluded, the BHA and workstring may be retrieved from the wellbore 10 by reversing the deployment and landing procedure, discussed above. The isolation valve 115 and SSV may then be closed by the vessel operator. The BHA may then be washed as discussed above for the upper crown plug 56*u*. The blind-shear preventer 120*b* may then be closed. If necessary, the vessel 400 may return to the position over the tree 50. The slack may be removed from the coiled tubing by the vessel injector (after or simultaneously with vessel movement). The ROV 415 may disconnect the adapter connector and the workstring module 500, 600 may be retrieved from the tree 50. If an intervention operation was conducted, the tree saver 590 may be removed and the crown plugs 56*u,l* reinstalled using the wireline module 500 and PRT. The PCA 100 may then be retrieved and the well returned to production.

While the foregoing is directed to embodiments of the present invention, other and further embodiments of the invention may be devised without departing from the basic scope thereof, and the scope thereof is determined by the claims that follow.

The invention claimed is:

1. A method for riserless intervention of a subsea well, comprising:

lowering a pressure control assembly (PCA) from a vessel to a subsea production tree;

fastening the PCA to the tree;

lowering a control pod from the vessel to the PCA using an umbilical;

fastening the control pod to the PCA;

lowering an end of a fluid conduit from the vessel to the PCA;

fastening the fluid conduit to the PCA using a dry break connection;

lowering an intervention assembly to the PCA; and fastening the intervention assembly to the PCA, wherein:

the fluid conduit comprises an upper portion and a lower portion connected by a second dry break connection, the umbilical comprises an upper portion and a lower portion connected by a shearable connection, a clump weight is connected to each of the fluid conduit upper portion and the umbilical upper portion, and the clump weights are each at a depth at or above a top of the intervention assembly.

2. The method of claim 1, wherein:

the fluid conduit upper portion is a length of coiled tubing and the fluid conduit lower portion is a length of hose, and the length of hose is fastened to the PCA.

3. The method of claim 2, wherein:

the first dry break connection comprises an actuator operable to lock the connection, and the second dry break connection is operable to release in response to tension exerted on the hose.

4. The method of claim 3, wherein the actuator comprises a shearable fastener operable to release the fluid conduit in response to a predetermined tension exerted on the fluid conduit.

5. The method of claim 1, wherein:

the control pod is fastened to the PCA by a pod receptacle comprising a latch and an actuator, the latch comprises a shearable fastener operable to release the control pod in response to a predetermined tension exerted on the umbilical, and the actuator is operable by either the control pod or a remotely operated vehicle (ROV).

6. A method for riserless intervention of a subsea well, comprising:

lowering a pressure control assembly (PCA) from a vessel to a subsea production tree;

fastening the PCA to the tree;

lowering a control pod from the vessel to the PCA using an umbilical;

fastening the control pod to the PCA;

lowering an end of a fluid conduit from the vessel to the PCA; and fastening the fluid conduit to the PCA using a dry break connection, wherein:

the control pod is fastened to the PCA by a pod receptacle comprising a latch and an actuator, the latch comprises a shearable fastener operable to release the control pod in response to a predetermined tension exerted on the umbilical, and the actuator is operable by either the control pod or a remotely operated vehicle (ROV).

7. The method of claim 6, wherein:

the fluid conduit comprises a length of coiled tubing and a length of hose, and the length of hose is fastened to the PCA.

8. The method of claim 7, wherein a clump weight is connected to the coiled tubing at a depth above a top of the PCA.

9. The method of claim 7, wherein the hose is connected to the coiled tubing by a second dry break connection.

10. The method of claim 9, wherein:

the first dry break connection comprises an actuator operable to lock the connection, and the second dry break connection is operable to release in response to tension exerted on the hose.

11. The method of claim 10, wherein the actuator comprises a shearable fastener operable to release the fluid conduit in response to a predetermined tension exerted on the fluid conduit.

12. The method of claim 6, wherein:

the umbilical comprises an upper portion and a lower portion, the umbilical portions are connected by a shearable connection.

13. The method of claim 12, wherein a clump weight is connected to the umbilical upper portion at a depth above a top of the PCA.

14. The method of claim 6, further comprising:

lowering an intervention assembly to the PCA; and fastening the intervention assembly to the PCA.

* * * * *